US012654075B2

(12) United States Patent
Golden et al.

(10) Patent No.: US 12,654,075 B2
(45) Date of Patent: Jun. 16, 2026

(54) GOLF CLUB HEAD WITH IMPROVED INERTIA PERFORMANCE

(71) Applicant: Acushnet Company, Fairhaven, MA (US)

(72) Inventors: Charles E. Golden, Encinitas, CA (US); Richard L. Cleghorn, Oceanside, CA (US); Ryuichi Sugimae, San Diego, CA (US)

(73) Assignee: Acushnet Company, Fairhaven, MA (US)

( * ) Notice: Subject to any disclaimer, the term of this patent is extended or adjusted under 35 U.S.C. 154(b) by 1044 days.

(21) Appl. No.: 17/835,403

(22) Filed: Jun. 8, 2022

(65) Prior Publication Data

US 2022/0305351 A1 Sep. 29, 2022

Related U.S. Application Data

(63) Continuation-in-part of application No. 17/713,464, filed on Apr. 5, 2022, which is a continuation-in-part of application No. 17/700,439, filed on Mar. 21, 2022, which is a continuation-in-part of application No. 16/912,276, filed on Jun. 25, 2020, now Pat. No. 11,331,546, which is a continuation-in-part of application No. 16/219,651, filed on Dec. 13, 2018, now abandoned.

(51) Int. Cl.
*A63B 53/04* (2015.01)

(52) U.S. Cl.
CPC ..... *A63B 53/0437* (2020.08); *A63B 53/0412* (2020.08); *A63B 53/0433* (2020.08); *A63B 53/0466* (2013.01)

(58) Field of Classification Search
CPC ..... A63B 53/0412; A63B 53/0466; A63B 53/0433; A63B 53/0437; A63B 2053/0491
USPC ..... 473/324–350, 287–292
See application file for complete search history.

(56) References Cited

U.S. PATENT DOCUMENTS 1,589,363 A * 6/1926 Butchart ..... A63B 60/00 473/344
4,076,254 A 2/1978 Nygren
4,139,196 A 2/1979 Riley
4,229,550 A 10/1980 Jones et al.
(Continued)

FOREIGN PATENT DOCUMENTS

CN 102886130 1/2003
CN 101060892 10/2007
(Continued)

OTHER PUBLICATIONS

The Royal and Ancient Golf Club of St. Andrews and USGA, Technical Description of the Pendulum Test revised version, Nov. 2003.

(Continued)

*Primary Examiner* — Sebastiano Passaniti

(57) ABSTRACT

A golf club head that is capable improving on the inertia properties of a golf club head all while also improving the Center of Gravity (CG) location is disclosed herein. More specifically, the golf club head in accordance with the present invention achieves a relative low Moment of Inertia (MOI) about the Z-axis (MOI-Z), a relatively low MOI about the Shaft-axis (MOI-SA), a low MOI about the Y-axis (MOI-Y) and a high MOI about the X-axis (MOI-X).

20 Claims, 18 Drawing Sheets

(56) References Cited

U.S. PATENT DOCUMENTS 4,448,941 A 5/1984 Cheung et al.
4,681,322 A 7/1987 Straza et al.
4,883,275 A * 11/1989 Boone ..... A63B 60/52 473/335
5,058,895 A 10/1991 Igarashi
5,120,062 A 6/1992 Scheie
5,132,178 A 7/1992 Chyung et al.
5,163,682 A 11/1992 Schmidt et al.
5,190,289 A 3/1993 Nagai et al.
5,238,529 A 8/1993 Douglas
5,295,689 A 3/1994 Lundberg
5,310,185 A 5/1994 Viollaz et al.
5,346,216 A 9/1994 Aizawa
5,354,055 A 10/1994 MacKeil
5,358,249 A 10/1994 Mendralla
5,362,055 A 11/1994 Rennie
5,380,010 A 1/1995 Werner
5,403,007 A 4/1995 Chen
5,405,136 A 4/1995 Hardman
5,425,538 A 6/1995 Vincent et al.
5,447,309 A * 9/1995 Vincent ..... A63B 53/04 473/335
5,489,094 A * 2/1996 Pritchett ..... A63B 53/04 473/343
5,499,814 A 3/1996 Lu
5,524,331 A 6/1996 Pond
5,547,427 A 8/1996 Rigal et al.
5,570,886 A 11/1996 Rigal
5,624,331 A 4/1997 Lo
5,665,014 A 9/1997 Sanford
5,720,673 A 2/1998 Anderson
5,743,813 A 4/1998 Chen et al.
5,839,975 A 11/1998 Lundberg
5,935,020 A 8/1999 Stites et al.
5,938,543 A * 8/1999 McGeeney ..... B29C 70/84 473/341
5,967,903 A 10/1999 Cheng
5,997,415 A 12/1999 Wood
6,048,278 A 4/2000 Meyer et al.
6,152,833 A 11/2000 Werner
6,162,133 A 12/2000 Peterson
6,254,494 B1 7/2001 Hasebe et al.
6,299,549 B1 10/2001 Shieh
6,315,678 B1 * 11/2001 Teramoto ..... A63B 53/10 473/291
6,340,337 B2 1/2002 Hasebe et al.
6,354,962 B1 3/2002 Galloway et al.
6,364,788 B1 4/2002 Helmstetter
6,425,832 B2 7/2002 Cackett et al.
6,440,008 B2 8/2002 Murphy et al.
6,454,664 B1 9/2002 Long et al.
6,491,592 B2 12/2002 Cackett
6,530,847 B1 3/2003 Antonious
6,533,681 B2 3/2003 Inoue et al.
6,558,271 B1 5/2003 Beach
6,572,491 B2 6/2003 Hasebe et al.
6,605,007 B1 8/2003 Bissonnette et al.
6,607,452 B2 * 8/2003 Helmstetter ..... B29C 70/865 473/345
6,617,013 B2 9/2003 Morrison et al.
6,623,378 B2 9/2003 Beach
6,623,543 B1 9/2003 Zeller et al.
6,669,577 B1 12/2003 Hocknell et al.
6,676,535 B2 1/2004 Sheets et al.
6,776,726 B2 8/2004 Sano
6,837,094 B2 1/2005 Pringle et al.
6,860,823 B2 3/2005 Lee
6,860,824 B2 3/2005 Evans
6,875,129 B2 4/2005 Erickson et al.
6,945,876 B2 9/2005 Nakahara et al.
6,945,877 B2 * 9/2005 Kobayashi ..... A63B 60/02 473/345
6,964,617 B2 11/2005 Williams
6,991,558 B2 * 1/2006 Beach ..... A63B 60/00 473/324
7,037,214 B2 5/2006 Nakahara et al.
7,056,229 B2 6/2006 Chen
7,063,628 B2 6/2006 Reyes
7,074,136 B2 7/2006 Noguchi et al.
7,108,614 B2 9/2006 Lo
7,137,905 B2 11/2006 Kohno
7,140,974 B2 11/2006 Chao et al.
7,147,572 B2 12/2006 Kohno
7,163,470 B2 1/2007 Galloway
7,166,038 B2 1/2007 Williams
7,258,624 B2 8/2007 Kobayashi
7,267,620 B2 9/2007 Chao et al.
7,281,991 B2 10/2007 Gilbert et al.
7,281,994 B2 10/2007 De Shiell et al.
7,303,488 B2 * 12/2007 Kakiuchi ..... A63B 53/0466 473/345
7,318,782 B2 1/2008 Imamoto
7,331,877 B2 2/2008 Yamaguchi et al.
7,344,450 B2 * 3/2008 Billings ..... A63B 53/047 473/409
7,344,452 B2 3/2008 Imamoto
7,347,796 B2 3/2008 Takeda
7,354,353 B2 4/2008 Hocknell et al.
7,361,100 B1 4/2008 Morales
7,422,528 B2 9/2008 Gibbs et al.
7,438,649 B2 10/2008 Ezaki
7,445,564 B2 * 11/2008 Kusumoto ..... A63B 53/0466 473/348
7,448,964 B2 11/2008 Schweigert
7,497,788 B2 * 3/2009 Imamoto ..... A63B 53/0466 473/335
7,497,789 B2 3/2009 Burnett
7,510,485 B2 3/2009 Yamamoto
7,510,486 B2 3/2009 Werner
7,628,712 B2 12/2009 Chao et al.
7,632,193 B2 12/2009 Thielen
7,632,195 B2 12/2009 Jorgensen
7,651,414 B2 1/2010 Rae
7,686,708 B2 3/2010 Morales
7,691,008 B2 4/2010 Oyama
7,717,803 B2 5/2010 DiMarco
7,771,291 B1 * 8/2010 Willett ..... A63B 53/0466 473/345
7,775,905 B2 8/2010 Beach
7,798,203 B2 9/2010 Schweigert
7,806,781 B2 10/2010 Imamoto
7,850,542 B2 12/2010 Cackett
7,861,395 B2 1/2011 Jorgensen
7,867,612 B2 1/2011 Schwung et al.
7,931,546 B2 4/2011 Bennett et al.
7,959,522 B2 6/2011 North, III
7,993,216 B2 8/2011 Lee
8,007,371 B2 * 8/2011 Breier ..... A63B 53/0466 473/345
8,025,591 B2 9/2011 de la Cruz
8,100,781 B2 1/2012 Burnett
8,172,697 B2 5/2012 Cackett
8,197,357 B1 6/2012 Rice
8,221,261 B2 7/2012 Curtis et al.
8,247,062 B2 8/2012 Morrison et al.
8,293,356 B2 10/2012 Merrill et al.
8,308,582 B2 11/2012 Tanimoto
8,353,786 B2 * 1/2013 Beach ..... A63B 60/02 473/345
8,419,569 B2 4/2013 Bennett et al.
8,444,506 B2 5/2013 Watson
8,460,123 B1 6/2013 DeMille et al.
8,475,292 B2 7/2013 Rahrig et al.
8,496,542 B2 7/2013 Curtis et al.
8,496,544 B2 7/2013 Curtis
8,517,859 B2 8/2013 Golden et al.
8,540,588 B2 9/2013 Rice
8,540,590 B2 9/2013 Tsukada et al.
8,591,353 B1 11/2013 Honea et al.
8,597,139 B2 12/2013 Jorgensen
8,622,847 B2 1/2014 Beach

(56) References Cited

U.S. PATENT DOCUMENTS 8,636,608 B2 1/2014 de la Cruz
8,636,610 B2 1/2014 Golden
8,661,879 B2 3/2014 Iwatsubo
8,715,109 B2 5/2014 Bennett et al.
8,753,226 B2 6/2014 Rice
8,758,161 B2 6/2014 Golden et al.
8,777,778 B2 7/2014 Solheim et al.
8,790,196 B2 7/2014 Solheim et al.
8,814,723 B2 8/2014 Tavares et al.
8,834,294 B1 * 9/2014 Seluga ..... A63B 53/04 473/345
8,858,362 B1 10/2014 Leposky et al.
8,864,602 B2 10/2014 Curtis et al.
8,876,625 B2 11/2014 Curtis et al.
8,876,629 B2 11/2014 Deshmukh et al.
8,979,671 B1 3/2015 DeMille et al.
9,079,078 B2 7/2015 Greensmith et al.
9,079,089 B2 7/2015 Lokken et al.
9,079,368 B2 7/2015 Tavares et al.
9,101,811 B1 8/2015 Goudarzi et al.
9,174,096 B2 11/2015 Sargent
9,192,831 B2 11/2015 Stites
9,205,312 B2 12/2015 Zimmerman
9,381,410 B2 7/2016 Golden
9,387,373 B1 7/2016 DeMille et al.
9,427,637 B2 8/2016 Beach
9,440,126 B2 9/2016 Boyd
9,498,688 B2 11/2016 Galvan
9,682,288 B2 * 6/2017 Rice ..... A63B 53/0466
9,687,700 B2 6/2017 Honea
9,776,054 B2 * 10/2017 Horacek ..... A63B 60/00
9,814,954 B2 11/2017 Westrum
9,868,036 B1 1/2018 Kleinert
9,908,014 B1 3/2018 Wester
9,950,222 B2 4/2018 Albertsen
9,968,834 B1 5/2018 Seluga
9,987,533 B2 6/2018 Oldknow
10,065,094 B2 9/2018 Wallin
10,207,160 B2 2/2019 Johnson
10,252,120 B2 * 4/2019 Ban ..... A63B 53/0466
10,293,225 B2 5/2019 Sargent
10,434,380 B2 10/2019 Kawaguchi
10,478,681 B2 11/2019 Franz
10,603,555 B2 3/2020 Beach
10,617,916 B2 4/2020 Milleman
10,675,514 B2 6/2020 Spackman
10,751,585 B2 8/2020 Johnson
10,799,775 B2 10/2020 Sargent
10,864,413 B2 12/2020 Stokke
11,027,178 B2 6/2021 Sugimae
11,040,256 B2 6/2021 Milleman
11,117,026 B2 9/2021 Stokke
2002/0193175 A1 12/2002 Soracco et al.
2003/0148818 A1 * 8/2003 Myrhum ..... A63B 69/3658 473/290
2004/0192468 A1 9/2004 Onoda
2005/0096154 A1 5/2005 Chen
2005/0143189 A1 6/2005 Lai et al.
2005/0239576 A1 10/2005 Stites
2008/0015047 A1 * 1/2008 Rice ..... A63B 60/00 473/329
2008/0096689 A1 * 4/2008 Oyama ..... A63B 53/0466 473/349
2008/0139336 A1 6/2008 DiMarco
2008/0161124 A1 7/2008 Kajita
2009/0088272 A1 4/2009 Foster et al.
2009/0092831 A1 4/2009 Stusgen et al.
2009/0170632 A1 7/2009 Beach et al.
2009/0286611 A1 * 11/2009 Beach ..... A63B 53/06 473/335
2010/0041494 A1 2/2010 Boyd
2010/0203983 A1 * 8/2010 Stites ..... A63B 60/02 473/345
2010/0304888 A1 * 12/2010 Hirano ..... A63B 53/0466 473/348
2011/0124435 A1 * 5/2011 Ehlers ..... C08G 18/10 473/345
2011/0143858 A1 * 6/2011 Peralta ..... A63B 53/04 473/335
2011/0224017 A1 9/2011 Thomas
2012/0142451 A1 6/2012 De Shiell
2013/0102414 A1 * 4/2013 De la Cruz ..... A63B 60/00 473/324
2013/0137531 A1 5/2013 Golden et al.
2013/0252757 A1 9/2013 Deshmukh et al.
2013/0303306 A1 11/2013 Curtis
2014/0004972 A1 1/2014 Thomas
2014/0038737 A1 2/2014 Roach
2014/0106897 A1 4/2014 Golden et al.
2015/0045134 A1 2/2015 Beno
2015/0108681 A1 4/2015 Deshmukh et al.
2015/0231453 A1 * 8/2015 Harbert ..... A63B 60/52 473/307
2015/0273293 A1 10/2015 Akiyama
2015/0290503 A1 10/2015 Su
2015/0297961 A1 10/2015 Voshall
2015/0298196 A1 10/2015 Su
2015/0335964 A1 11/2015 Sander
2015/0360094 A1 12/2015 Deshmukh
2016/0008677 A1 * 1/2016 Kitagawa ..... A63B 53/0466 473/331
2016/0287954 A1 10/2016 Sargent
2017/0050091 A1 2/2017 Shimahara
2017/0259128 A1 9/2017 Greensmith
2018/0085641 A1 * 3/2018 Breier ..... A63B 53/0475
2019/0022478 A1 1/2019 Greaney
2019/0336834 A1 * 11/2019 Greaney ..... A63B 53/0412
2020/0121999 A1 4/2020 Sargent
2020/0188746 A1 * 6/2020 Sugimae ..... A63B 53/045
2020/0206589 A1 7/2020 Parsons
2021/0138323 A1 5/2021 Harbert
2021/0220709 A1 7/2021 Johnson
2021/0283473 A1 9/2021 Stokke

FOREIGN PATENT DOCUMENTS

GB 2450764 7/2009
JP H05-7261 2/1993
JP 11-319166 11/1999
JP 2000-210398 8/2000
JP 2002-239041 8/2002
JP 2003-111874 4/2003
JP 2003-250938 9/2003
JP 2004-159794 6/2004
JP 2005-058461 3/2005
JP 2005-323686 11/2005
JP 2005-329154 12/2005
JP 2005-348895 12/2005
JP 2006-020860 1/2006
JP 2004-208728 7/2007
JP 2008-148762 3/2008
JP 2009-011839 1/2009
JP 2011-253586 12/2011
JP 2014-501167 1/2014

OTHER PUBLICATIONS

Machine Translation of JPH05-7261.
Jackson, Jeff. The Modern Guide to Golf Clubmaking,. Ohio: Dyanacraft Golf Products, Inc. copyright 1994, pp. 236-237.

* cited by examiner

GOLF CLUB HEAD WITH IMPROVED INERTIA PERFORMANCE

CROSS-REFERENCE TO RELATED APPLICATIONS

This application is a continuation-in-part of co-pending U.S. patent application Ser. No. 17/713,464, filed on Apr. 5, 2022, which is a continuation-in-part of co-pending U.S. patent application Ser. No. 17/700,439, filed on Mar. 21, 2022, which is a continuation-in-part of U.S. patent application Ser. No. 16/912,276, filed on Jun. 25, 2020, which issued as U.S. Pat. No. 11,331,546 and is a continuation-in-part of U.S. patent application Ser. No. 16/219,651, filed on Dec. 13, 2018, now abandoned, all of which are hereby incorporated by reference in their entirety.

FIELD OF THE INVENTION

The present invention relates generally to a new and improved golf club having improved Moment of Inertia (MOI) characteristics, combined with an improved Center of Gravity (CG) location. More specifically, the golf club head in accordance with the present invention achieves a relative low Moment of Inertia (MOI) about the Z-axis (MOI-Z), a low MOI about the Shaft Axis (MOI-SA), all combined with a high MOI about the X and Y-axis (MOI-X and MOI-Y) and maintaining a consistently and relatively low CG location measured along a direction tangent to the hosel axis along the X-Y plane (CG-B).

BACKGROUND OF THE INVENTION

With the development of the modern day oversized metalwoods, the performance capabilities of these types of golf clubs have increased dramatically over their predecessor, "the persimmon wood". One of the ways these metalwood type golf clubs have been performing better than their predecessors is in the increase in overall distance, generally attributed to the inherent elastic deformation of thin metallic metal materials used by these metalwoods. Another way the metalwood type golf clubs have been outperforming their predecessors is in the increase in overall forgiveness of the golf club head, generally attributed to the increase in the MOI of the golf club head itself.

The MOI of a golf club head generally is a term used to describe the ability of an object to resist rotational movement upon impact with a secondary object. In the case of a golf club head, MOI refers to the ability of the golf club head to resist undesirable twisting upon impact with a golf ball, as such a twisting movement will generally change the face angle of the golf club head away from the intended target line, sending the golf ball away from the intended target.

U.S. Pat. No. 5,354,055 to MacKeil shows one of the earliest attempts to increase the MOI of a golf club head by placing the Center of Gravity (CG) location rearward. U.S. Pat. No. 6,364,788 to Helmstetter et al. shows the utilization of weighting members to help control the MOI of the golf club head. Both of these patents refer to the MOI-y of the golf club head, as it relates to the ability of the golf club head to stay stable when encountering an off-center impact in the heel and toe direction.

U.S. Pat. No. 7,850,542 to Cackett et al. illustrates a further development in the MOI research wherein a recognition of the different axis of rotation of the different MOI's. (Alternatively known as Ixx, Iyy, and Izz instead of MOI-X, MOI-Y, and MOI-Z) Despite the recognition and identification of the difference in MOI values, U.S. Pat. No. 7,850,542 only focuses its attention on Ixx and Iyy (adapted and changes to the current reference nomenclature), without any recognition of the importance of the last MOI number, Izz, nor MOI-SA and how they can affect the performance of the golf club.

Despite the above, none of the references recognizes the importance of the MOI of the golf club head horizontally forward and aft of the face (MOI-Z), and ways to design a golf club that takes advantage of the performance characteristics of golf club with more optimal MOI-Z values along with the minimized MOI-SA values. Moreover, a closer investigation of the MOI-Z values will yield CG locations that will work in conjunction with the above MOI-Z values to create more performance. Hence, it can be seen from the above there is a need for more research and a design of a golf club capable of achieving better performance by investigating the importance of MOI-Z and MOI-SA as well as the CG location and designing a golf club head.

BRIEF SUMMARY OF THE INVENTION

One aspect of the present invention is a golf club head comprising of a frontal portion further comprising a striking face that defines a face center, located at a forward portion of the golf club head; a rear portion located aft of the striking face; and at least one weighting member located near a central portion of the golf club head in a heel to toe orientation, substantially in line with and behind the face center; wherein an x-axis is defined as a horizontal axis tangent to a geometric center of said striking face with the positive direction towards a heel of said golf club head, a y-axis is a horizontal axis orthogonal to said x-axis with a positive direction towards a crown of said golf club head, and a z-axis being orthogonal to both said x-axis and said y-axis with a positive direction towards a frontal portion of said golf club head, and wherein said golf club head has a MOI-Y to MOI-Z ratio of greater than about 1.50.

In another aspect of the present invention is a golf club head comprising of a golf club head comprising of a frontal portion further comprising a striking face that defines a face center, located at a forward portion of the golf club head, a rear portion located aft of the striking face, and at least one weighting member located near a central portion of the golf club head in a heel to toe orientation, substantially in line with and behind the face center; wherein an x-axis is defined as a horizontal axis tangent to a geometric center of said striking face with the positive direction towards a heel of said golf club head, a y-axis is a horizontal axis orthogonal to said x-axis with a positive direction towards a crown of said golf club head, and a z-axis being orthogonal to both said x-axis and said y-axis with a positive direction towards a frontal portion of said golf club head, and wherein said golf club head has a MOI-X, MOI-Z, and CG-Z numbers that satisfies the equation $$\frac{MOI-X}{MOI-Z} \geq (6.7501 * CG-Z) - 99.30.$$

In another aspect of the present invention, the golf club head has a volume of 250 cc to 400 cc. More particularly, the golf club head comprises a frontal portion further comprising a striking face that defines a face center, located at a forward portion of the golf club head, a rear portion located aft of the striking face, and at least one weighting member located near a central portion of the golf club head in a heel to toe orientation, substantially in line with and behind the face center; wherein an x-axis is defined as a horizontal axis tangent to a geometric center of said striking face with the positive direction towards a heel of said golf club head, a y-axis is a vertical axis orthogonal to said x-axis with a positive direction towards a crown of said golf club head, and a z-axis being orthogonal to both said x-axis and said y-axis with a positive direction towards a frontal portion of said golf club head. The golf club head in accordance with the present invention achieves a relative low Moment of Inertia (MOI) about the z-axis (MOI-Z), a low MOI about the shaft axis (MOI-SA), all combined with a high MOI about the x-axis and low MOI about the y-axis (MOI-X and MOI-Y) and maintaining a consistently and relatively low CG. Moreover, the preferred embodiment golf club head has a MOI-X, MOI-Y, MOI-Z, CG-Z and CG-Y numbers that satisfies a number of equations. In one embodiment, the golf club head can have a MOI-X/MOI-Y of greater than or equal to 0.65. In another embodiment, the golfclub head can have a CG-Z to club head depth ratio of greater than or equal to about 0.33. Moreover, the golf club head can have a CG-Y to crown height ration of less than or equal to about 0.35.

In yet another embodiment, a golf club head can be comprised of a center portion having a center face portion, a center crown portion and a center sole portion; a toe having a toe face portion, a toe crown portion and a toe skirt portion; and a heel portion having a heel face portion, a heel crown portion and a heel skirt portion. The center portion, toe portion and heel portion define a club head volume of greater than about 420 cc and more preferably between 440 cc and 460 cc. The golf club head preferably includes at least a crown weight member located on the center crown portion of said golf club head and a sole weight member located on the center sole portion of said golf club head. The golf club head has center of gravity and a moment of inertia about said x-axis through the center of gravity (MOI-X), a moment of inertia about said y-axis through the center of gravity (MOI-Y), and a moment of inertia about said z-axis through the center of gravity (MOI-Z), and the MOI-Y is preferably less than 400 kg-mm$^2$ and the golf club head has a MOI-X to MOI-Y ratio of greater than about 0.7. Preferably, the golf club head MOI-Y is less than 300 kg-mm$^2$. Moreover, it is preferred that the center of gravity is a vertical distance up from a ground plane that is at less than about 0.4 times a face height from the ground plane and less than about 0.35 times a crown height from the ground plane. More preferably, the MOI-X is less than 300 kg-mm$^2$ and the MOI-Y is between about 250 kg-mm$^2$ and 300 kg-mm$^2$.

In a more preferred embodiment, the golf club head has a crown weight member with a mass of about 5 g to about 20 g and a sole weight member with a mass of between about 40 g to about 75 g. Preferably, the crown weight mass is between about 10 g and 15 g and the sole weight mass is between about 50 g and 60 g. The crown weight member has a crown weight mass center of gravity and the sole weight member has a sole weight mass center of gravity that are both spaced from the golf club head center of gravity along the z-axis by less than 0.5 inch, and more preferably, less than 0.25 inch. Also, the crown weight mass center of gravity and the sole weight mass center of gravity are spaced from the golf club head center of gravity along the y-axis by greater than 0.5 inch, and more preferably, by greater than 0.6 inch. Most preferably, the crown weight mass center of gravity and the sole weight mass center of gravity is spaced from the center of gravity by 0.1 inch in the z-direction and 0.7 inch in the y-direction.

The golf club head preferably has a center face portion with a center width that is between about 1.5 inch and 2 inches when measured parallel to the x-axis across the face center, a toe face portion with a toe width that is between 0.75 inch and 1 inch when measured parallel to the x-axis across the face center, and a heel face portion with a heel width that is between 0.75 inch and 1 inch when measured parallel to the x-axis across the face center. Preferably, the center portion is formed from titanium or titanium alloy and the toe portion and the heel portion are formed from thermoplastic material that is comprised of polyetherimide, polyether ether ketone, polyphenylene sulfide, polysulfone, polyacryletherketone, polyetherketoneketone, or polyvinyl chloride.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below and each can be used independently of one another or in combination with other features. However, any single inventive feature may not address any or all of the problems discussed above or may only address one of the problems discussed above. Further, one or more of the problems discussed above may not be fully addressed by any of the features described below.

Before beginning the discussion on the current inventive golf club head and its performance criteria, it is worthwhile to note here that the discussion below will be based on a coordinate system 101 and axis of measurement that is critical to the proper valuation of the performance numbers. Hence, it is important to recognize here that although the specific names given for the measurements below are important to the understanding of the current invention, the naming nomenclature should not be viewed in vacuum. Rather, the importance is the numbers presented below needs to be taken in context with how the coordinate system relates to the golf club head itself. In order to provide sufficient information to avoid any ambiguity, each of the figures provided below referencing a golf club head will all be accompanied by a coordinate system that is all consistent with one another.

Figure 1:
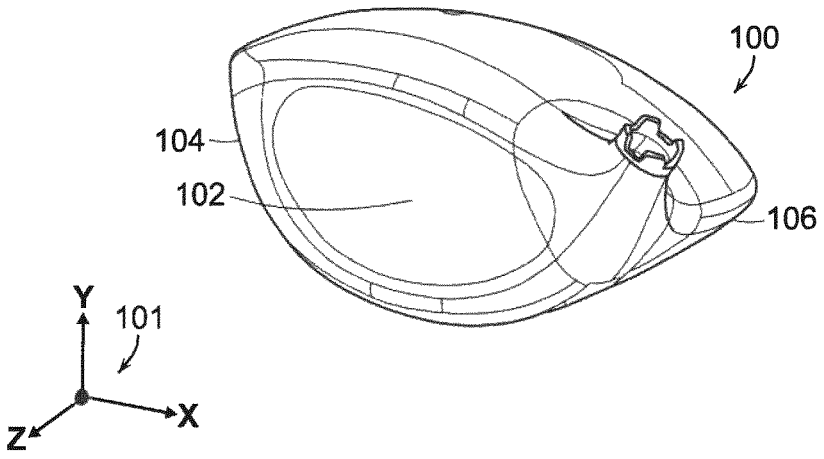
FIG. 1 of the accompanying drawings shows a perspective view of a golf club head in accordance with an exemplary embodiment of the present invention.

Pursuant to the above, and to establish the reference coordinate system for the subsequent discussion, FIG. 1 of the accompanying drawings shows the coordinate system 101 that will be used to define the various measurement and performance figures for the current invention. The x-axis used by the current discussion refers to the axis that is horizontal to the striking face from a heel to toe direction. The y-axis used by the current discussion refers to the vertical axis through the club in a crown to sole direction. The z-axis used by the current discussion refers to the horizontal axis that is horizontal front to back in a forward and rear direction. Alternatively speaking, it can be the x-axis is defined as a horizontal axis tangent to a geometric center of the striking face with the positive direction towards a heel of the golf club head, a y-axis is a horizontal axis orthogonal to the x-axis with a positive direction towards a top of the golf club head, and a z-axis being orthogonal to both the x-axis and the y-axis with a positive direction towards a front of the golf club head. The x-y-z coordinate system described above shall be the same for all subsequent discussions.

FIG. 1 of the accompanying drawings shows a perspective view of a golf club head 100 in accordance with an embodiment of the present invention. In this perspective view shown in FIG. 1, the golf club head 100 may not look very different than other golf club heads, but the subsequent figures and discussion will show that the internal components and the material properties of this golf club head 100 allows it to achieve unique performance properties consistent with the present invention. What FIG. 1 does show is a location of a face center 102 of the frontal portion 104 of the golf club head 100 that contains a striking face insert. The face center, as shown here and referred to by the current invention, relates to the geometric center of the striking face portion of said golf club head 100 measured by the USGA provided face center template as it would be commonly known to a person of ordinary skill in the golf club art. Attached to the rear of the frontal portion 104 is a rear portion 106, which makes up the back end of the golf club head 100.

In this embodiment of the present invention, the frontal portion 104 may generally be made out of a steel type material having a density of between about 7.75 g/cc and about 8.00 g/cc, allowing a significant portion of the mass of the golf club head 100 to be concentrated at a frontal bottom region of the golf club head 100. The rear portion 106 of the golf club head 100 in this embodiment of the present invention may generally be made out of the standard titanium material having a density of between about 4.00 g/cc and about 5.00 g/cc, allowing the rear portion 106 of the golf club head 100 to be relatively lightweight. However, it should be noted that in alternative embodiments of the present invention, the frontal portion 104 may also be made out of a standard titanium material such as TI-6-4, Ti-8-1-1, SP-700, or any other type of titanium material without departing from the scope and content of the present invention.

Figure 2:
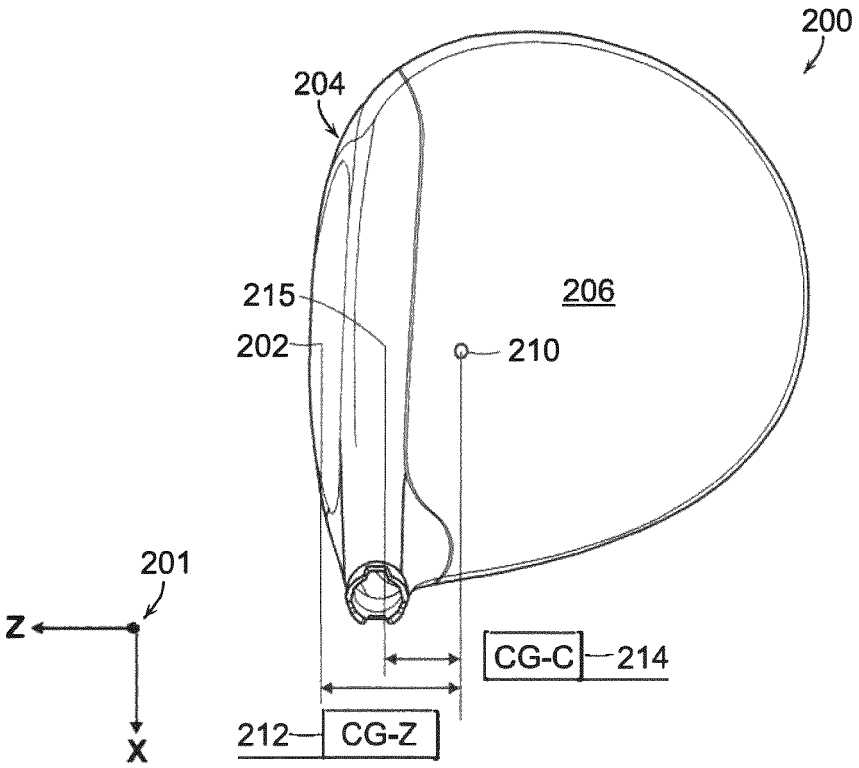
FIG. 2 of the accompanying drawings shows a top view of a golf club head in accordance with an exemplary embodiment of the present invention.
Figure 3:
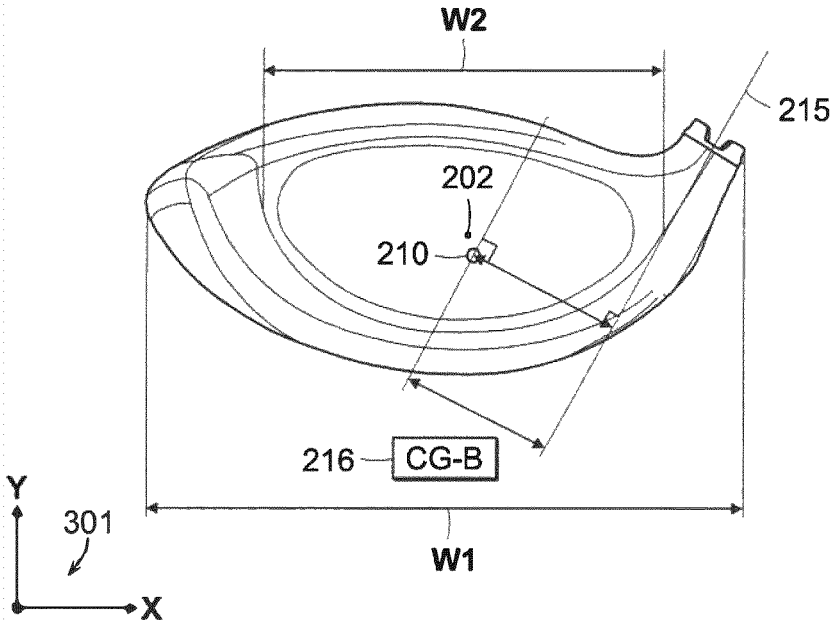
FIG. 3 of the accompanying drawings shows a frontal view of a golf club head in accordance with an exemplary embodiment of the present invention.

In order to illustrate more specific features of the golf club head 100, FIGS. 2 and 3 of the accompanying drawings is provided to give more insight into some of the specific inherent characteristics of the golf club head 200 that will be important to determine its improved performance. First off, FIG. 2 of the accompanying drawings, in addition to illustrating a golf club head 200 with a frontal portion 204 and a rear portion 206, also shows a Center of Gravity (CG) 210 location along the x-z plane on the coordinate system 201. Although the details of the CG location will be discussed in more detail with respect to the inertia properties of the golf club head 200, the general direction of the current inventive golf club head 200 is to have a CG location that is strategically located at a distance back from the frontal portion of the golf club head 200 to yield the most advantageous results.

More specifically, in the current invention, the CG location rearward from the striking face, identified here as CG-Z is generally between about 25 mm to about 40 mm, more preferably between about 26 mm and about 38 mm, and most preferably between about 27 mm and about 36 mm, all measured rearward from the face center 202 along the Z axis shown by the coordinate system 201. In addition to illustrating the CG-Z 212 numbers, an alternative measurement method is provided to measure how far back the CG 210 is located within the club head 200. In this alternative method, the CG 210 is measured from the shaft axis 215, and this measurement is illustrated as CG-C 214 is generally measured to be between about 10 mm to about 25 mm, more preferably between about 12 mm to about 23 mm, and most preferably between about 14 mm to about 21 mm, all measured rearward from the shaft axis 215 along the Z axis shown by the coordinate system 201.

It should be noted that the strategic location of the CG 210 location rearward along the Z axis, irrespective of whether it is measured from the face center 202 or the shaft axis 215, is critical to the proper functionality of the current inventive golf club head 200. If the CG 210 location is too far forward, the golf club head 200 can result in a low MOI-X and MOI-Y as well as too low of a backspin when contacting a golf ball to yield desirable results. However, in the alternative, if the CG 210 location is too far rearward, the golf club head 200 can produce too much spin to yield desirable results. Hence, it can be seen that the criticality of the CG location rearward of along the Z axis is a fine balance of a very specific range of numbers that can severely hinder the performance of the golf club head 200 if it deviates from the ranges articulated above.

FIG. 3 of the accompanying drawings shows another important CG 210 measurement that is important to the proper functionality of the current invention. More specifically, FIG. 3, in addition to illustrating all of the basic components of the golf club head 200 as previously shown, now introduces another measurement of the CG 210 location from the shaft axis 215 along an x-y plane shown by coordinate system 301. More specifically, FIG. 3 shows a CG 210 measurement that is perpendicular to the shaft axis 215 along this x-y plane away from the actual shaft axis 215 itself, called CG-B for the purpose of this application. The CG-B of the golf club head 210 may generally be between about 32 mm and about 39 mm, more preferably between about 33 mm and about 38 mm, and most preferably about 35 mm.

In addition to illustrating the very important CG-B measurement of the golf club head, FIG. 3 of the accompanying drawings also shows measurements W1 and W2, indicative of the width of the golf club head 200 itself and the width of the face of the golf club head 200 respectively. In this embodiment of the present invention, the width of the golf club head W1 may generally be between about 130 mm to and about 140 mm, more preferably between about 132 mm to about 138 mm, and most preferably about 136 mm. The width of the face W2 may generally be between about 95 mm and about 105 mm, more preferably between about 97 mm and about 103 mm, and most preferably about 100 mm.

Now that the CG location of the golf club head 200 has been defined, the other important features associated with the present invention relates to the Moment of Inertia (MOI) of the golf club head 200. The MOI of a golf club head generally depicts the ability of the golf club head to resist twisting when it impacts an object at a location that is not aligned with the CG location previously discussed. More specifically, the MOI of a golf club head relates to the ability of the golf club head to resist twisting relative to the CG location. As is well known in the art, the MOI of the golf club head 200 may generally be broken down to three unique components, relating to the ability of the golf club head 200 to resist rotation along three different axes, with the origin of the three axes being coincident with the CG location of the golf club head. The three axes of rotation for which the MOI is generally referred coincides with the coordinate system 101, 201, and 301 (shown in FIG. 1, FIG. 2, and FIG. 3 respectively), where MOI-X is measured about the X axis passing through the CG location, MOI-Y is measured about the Y axis passing through the CG location, and MOI-Z is measured about the Z axis passing through the CG location.

As the previously discussion already hinted, the current inventive golf club head 200 may generally have a high value for the MOI about the X and Y axis, while maintaining a low MOI about the Z axis. More specifically, the current inventive golf club head 200 may generally have a MOI about the X axis (MOI-X) that is greater than about 300 kg-mm$^2$, more preferably greater than about 310 kg-mm$^2$, and most preferably greater than about 320 kg-mm$^2$ without departing from the scope and content of the present invention. As for MOI about the Y axis (MOI-Y), the present inventive golf club head 200 may generally have a MOI about the Y axis that is greater than about 400 kg-mm$^2$, more preferably greater than about 410 kg-mm$^2$, and most preferably greater than about 420 kg-mm$^2$ all without departing from the scope and content of the present invention.

While the large MOI number about the X and Y axis discussed previously are not necessarily new in the world of golf club head 200 designs, the ability to maintain those number while decreasing the MOI about the Z axis (MOI-Z) and holding the MOI about the Shaft axis (MOI-SA) to a minimum is what makes the present invention. While the majority of the golf industry are focusing their attention so intently on the ability of the golf club head 200 to offer forgiveness on off center hits by trying to increase the MOI-Y to astronomical numbers, they have failed to recognize the ability of the golf club head 200 to offer more club head speed and more ball speed by decreasing the MOI about the Z axis (MOI-Z) in concert with the minimization of MOI about the Shaft axis (MOI-SA). The present invention focuses its attention on that very specific unrecognized characteristic, and has developed a golf club head 200 design to take advantage and maximize the performance of the golf club head 200 by focusing on the MOI about the Z axis. More specifically, a golf club head 200 in accordance with the present invention may generally have a MOI about a Z axis that is less than about 268 kg-mm$^2$, more preferably less than about 260 kg-mm$^2$, and most preferably less than about 250 kg-mm$^2$. Additionally, the golf club head 200 may generally have a MOI about a Shaft axis that is less than about 850 kg-mm$^2$.

It should be noted here that the low MOI-Z numbers mentioned above cannot by itself accurately depict and describe the current invention; as old school golf club heads with much smaller footprint may inherently have a low MOI-Z number, combined with a low MOI-X and MOI-Y number. Hence, it is important to recognize here that the present invention is predicated on the interrelationship between the different numbers achieved by the MOI-X and MOI-Y numbers as it relates to MOI-Z and MOI-SA, in combination with the CG location articulated above.

In order to capture the essence of the present invention, a ratio can be created between the MOI-X, MOI-Y, and MOI-Z to help provide one way to quantify this relationship. In one first example, a MOI-X to MOI-Z Ratio can be created to help quantify the current golf club head 200 as illustrated by Eq. (1) below. In one exemplary embodiment of the present invention, the MOI-X to MOI-Z Ratio is greater than about 1.10, more preferably greater than about 1.20, and most preferably greater than about 1.28.

$$MOI\text{-}X \text{ to } MOI\text{-}Z \text{ Ratio} = \frac{MOI\text{-}X}{MOI\text{-}Z} \quad \text{Eq. (1)}$$

Similarly, a comparable ratio can be established called a MOI-Y to MOI-Z Ratio to quantify the current golf club head 200 as illustrate by Eq. (2) below. In one exemplary embodiment of the present invention, the MOI-Y to MOI-Z ratio is greater than about 1.50, more preferably greater than about 1.57, and most preferably greater than about 1.68.

$$MOI\text{-}Y \text{ to } MOI\text{-}Z \text{ Ratio} = \frac{MOI\text{-}Y}{MOI\text{-}Z} \quad \text{Eq. (2)}$$

As it can be seen from the relationship established by the Eqs (1) and (2) above, the present invention relates to a specific relationship between the MOI of the golf club head 200 with an extra focus on minimizing the MOI-Z about the Z axis while maintaining a high MOI-Y. In order to further illustrate this, a graphical representation of the relationship is provided as FIG. 4.

Figure 4:
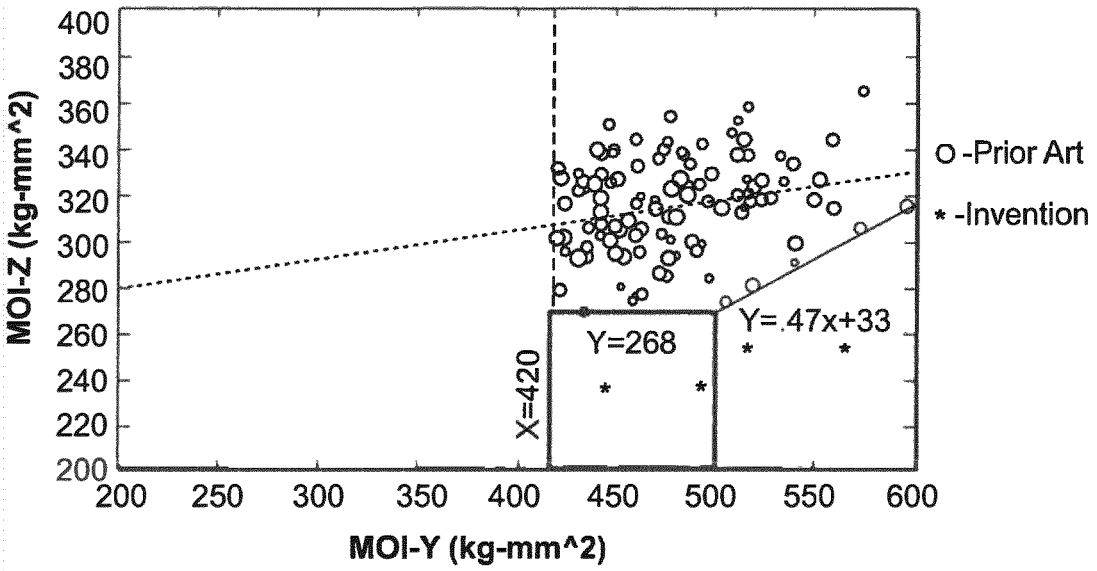
FIG. 4 of the accompanying drawings shows a plot of MOI-Z vs MOI-Y numbers for the current invention, compared to prior art golf club heads.

FIG. 4 of the accompanying drawings shows a plot of various data points of various golf club head and their respective MOI-Z numbers as well as their MOI-Y number. In FIG. 4 the X-axis represents the MOI-Y while the Y-axis represents the MOI-Z. The data points shown in FIG. 4 have been separated into circular dots and asterisks. The circular dots are representative of the data of "prior art" golf club heads, whereas the asterisk data points represent the current invention.

A closer examination of the prior art data points will show that none of the golf club heads in the prior art are capable of achieving a MOI-Z number of lower than 268 kg-mm$^2$, for all modern day golf club heads that have a MOI-Y of greater than 420 kg-mm$^2$. However, an even closer examination of the graph of FIG. 4 will show that as the MOI-Y numbers of the golf club heads exceeds 500 kg-mm$^2$, an additional relationship can be established to quantify the ability of the present invention to achieve the optimal MOI-Z to MOI-Y relationship. In fact, that relationship is shown in FIG. 4 as $Y \leq 0.47x+33$. Combining the two conditions articulated above can result in another unique way to quantify the present invention whereas, for golf club heads having a MOI-Y of between 420 kg-mm$^2$ and 500 kg-mm$^2$, the golf club head generally has a MOI-Z of less than about 268 kg-mm$^2$; however, for golf club heads having a MOI-Y of greater than 500 kg-mm$^2$, the golf club head may have a MOI-Z that satisfies Eq. (3) below:

$$\text{MOI-}Z \leq (0.47*\text{MOI-}Y)+33 \quad \text{Eq. (3)}$$

Alternatively speaking, it can be said that in one embodiment of the present invention, the golf club head 200 may have a MOI-Z that satisfies the relationship $\text{MOI-}Z \leq (0.47*\text{MOI-}Y)+0.33$ if the MOI-Y number is greater than 500 kg-mm$^2$, and a MOI-Z that is less than 268 kg-mm$^2$ if the MOI-Y number is between 420 kg-mm$^2$ and 500 kg-mm$^2$.

Figure 5:
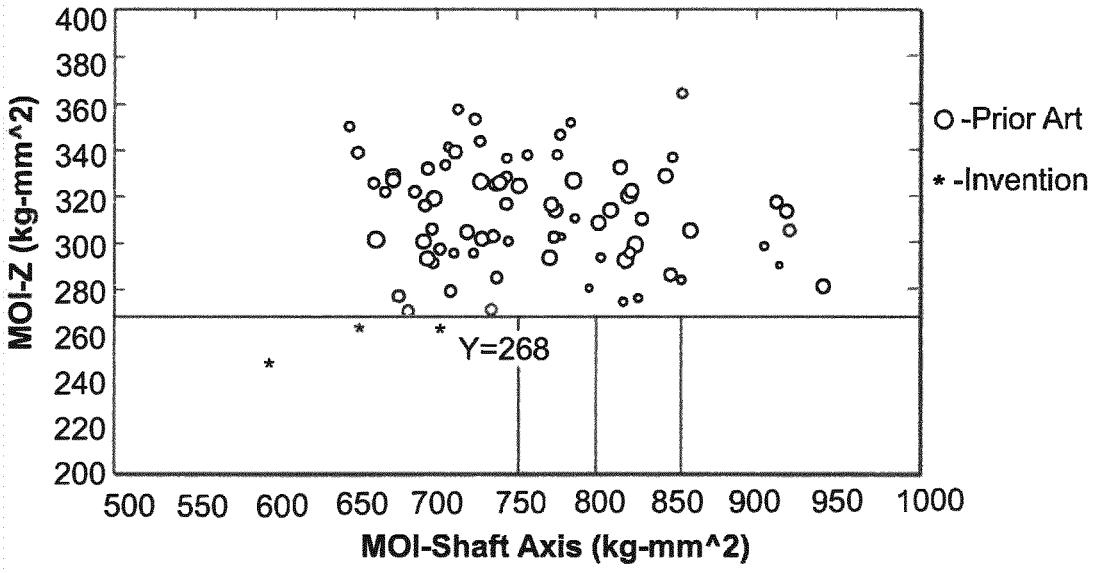
FIG. 5 of the accompanying drawings shows a plot of MOI-Z vs MOI-Shaft Axis numbers for the current invention, compared to prior art golf club heads.

FIG. 5 of the accompanying drawing introduces another MOI value relating to a golf club head not previously discussed named MOI-Shaft Axis (MOI-SA). The MOI of a golf club head as it relates to the shaft axis is defined as the ability of the golf club head to resist twisting upon impact with a golf ball at a location that is not aligned with the shaft axis. A golf club head in accordance with the present invention may generally have a MOI-SA of less than about 850 kg-mm$^2$, more preferably less than about 800 kg-mm$^2$, and most preferably less than about 750 kg-mm$^2$. The relationship between the MOI-SA and MOI-Z is highlighted in FIG. 5 and is important to the present invention. FIG. 5 of the accompanying drawings shows that irrespective of the MOI-SA numbers, all of the prior art golf club heads have a MOI-Z of greater than about 268 kg-mm$^2$, while all of the current inventive golf club heads have a MOI-Z of less than about 268 kg-mm$^2$.

Figure 6:
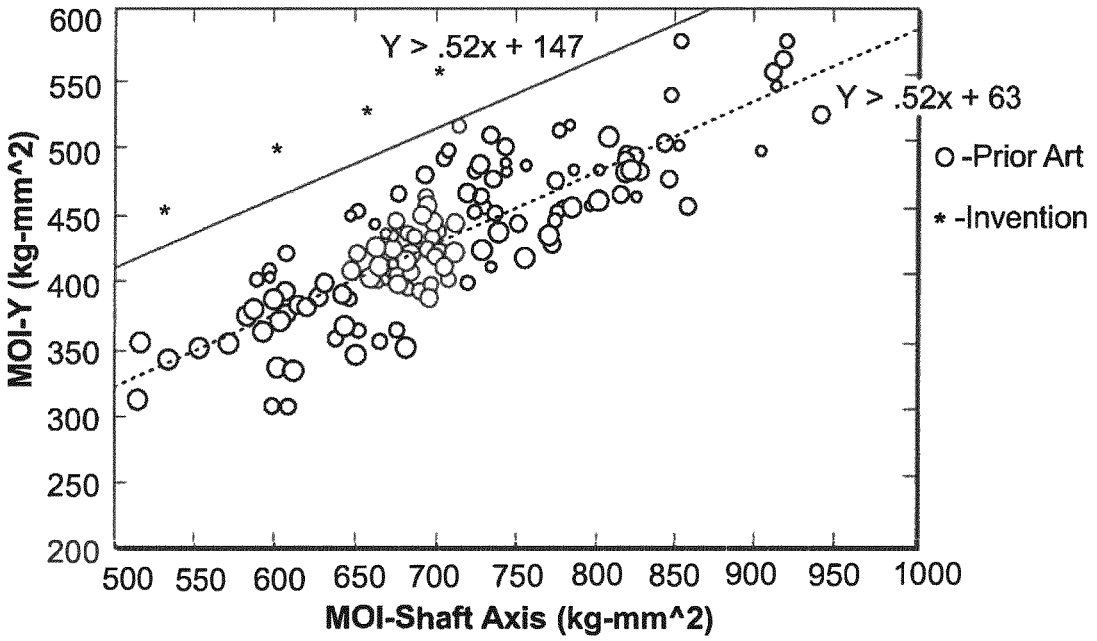
FIG. 6 of the accompanying drawings shows a plot of MOI-Y vs MOI-Shaft Axis numbers for the current invention, compared to prior art golf club heads.

FIG. 6 of the accompanying drawings establishes a graphical relationship between the MOI-Y of the golf club head with the newly introduced MOI-SA. As a closer examination of the graph shown in FIG. 6 will show, the current invention is capable of achieving a higher than average MOI-Y, all while keeping a relatively small MOI-SA. Similar to previous plots, the circular points on the plot will refer to prior art golf club heads, while the asterisks will refer to the current invention. Hence, it can be seen that the present invention occupies a previously unachieved space delineated by an equation $Y \geq 0.52x+147$, which when put into context with the variables used in this plot, yields Eq. (4) below:

$$\text{MOI-}Y \geq (0.52*\text{MOI-SA})+147 \quad \text{Eq. (4)}$$

Figure 7:
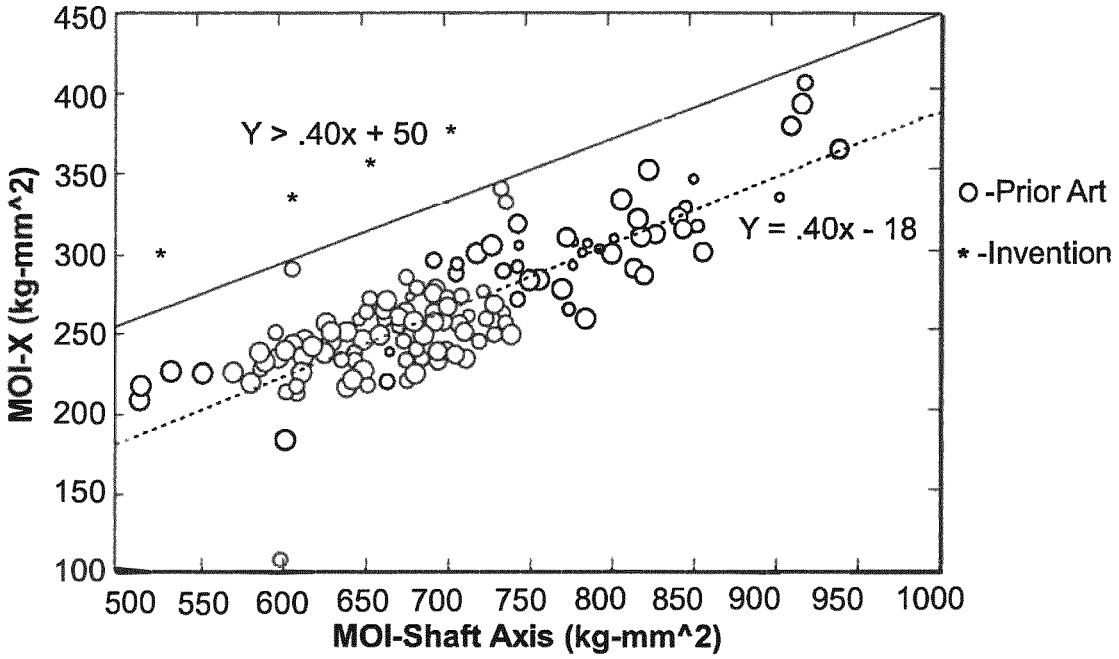
FIG. 7 of the accompanying drawings shows a plot of MOI-X vs MOI-Shaft Axis numbers for the current invention, compared to prior art golf club heads.

FIG. 7 of the accompanying drawings establishes a graphical relationship between the MOI-X of the golf club head with now a familiar MOI-SA. As a closer examination of the graph shown in FIG. 7 will show, the current invention is capable of achieving a higher than average MOI-X, all while keeping a relatively small MOI-SA. Hence, it can be seen that the present invention occupies a previously unachieved space delineated by an equation $Y \geq 0.40x+50$, which when put into context with the variables used in this plot, yields Eq. (5) below:

$$\text{MOI-}X \geq (0.40*\text{MOI-SA})+50 \quad \text{Eq. (5)}$$

Figure 8:
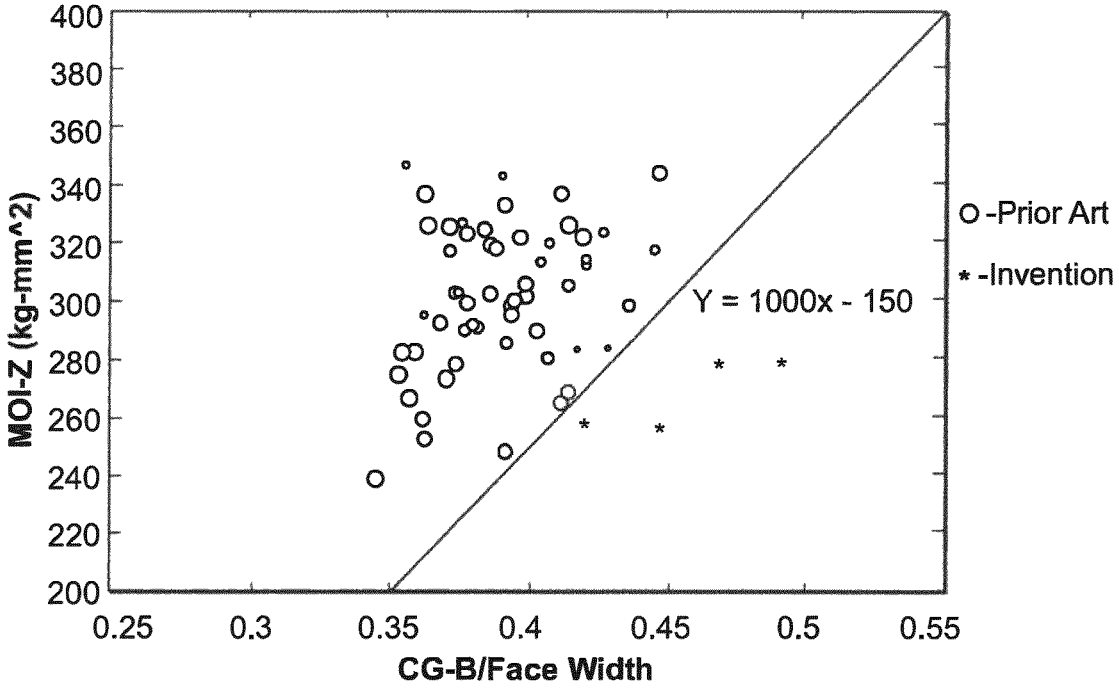
FIG. 8 of the accompanying drawings shows a plot of MOI-Z vs CG-B/Face Width numbers for the current invention, compared to prior art golf club heads.

FIG. 8 of the accompanying drawings establishes a graphical relationship between the MOI-Z of the golf club head with a ratio of CG-B/Face Width. Both the measurement for CG-B and Face Width can be found in FIG. 3 of the accompanying drawings as well as the accompanying discussion in paragraphs [0022] and [0023]. The CG-B measurement is explicitly shown in FIG. 3, while the Face Width referred to by the chart in FIG. 8 is shown as W2. A closer examination of the graph shown in FIG. 8 will show that the current invention is capable of achieving a lower MOI-Z, while keeping the CG-B/Face Width number fairly consistent above 0.4. CG-B/Face Width is indicative of the location of the center of gravity while keeping a moderately sized face golf club head.

In the chart shown in FIG. 8, it can be seen that the present invention occupies a previously unachieved space delineated by an equation Y≤1000x-150, which when put into context with the variable used in this plot, yields Eq. (6) below:

$$MOI-Z \leq \left(1000 * \frac{CG-B}{\text{Face Width}}\right) - 150 \quad \text{Eq. (6)}$$

Figure 9:
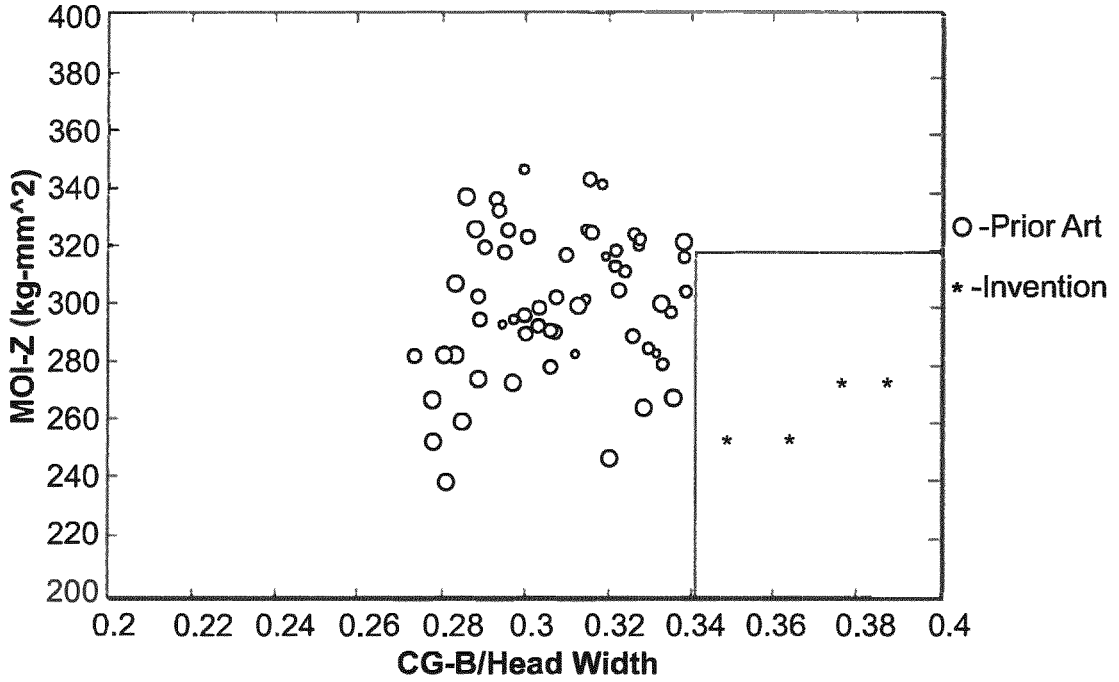
FIG. 9 of the accompanying drawings shows a plot of MOI-Z vs CG-B/Head Width numbers for the current invention, compared to prior art golf club heads.

FIG. 9 of the accompanying drawings establishes a graphical relationship between the MOI-Z of the golf club head with a ratio of CG-B/Head Width. Both the measurement for CG-B and Head Width can be found in FIG. 3 of the accompanying drawings as well as the accompanying discussion above in paragraph [0022] and [0023]. The CG-B measurement is explicitly shown in FIG. 3, while the Head Width referred to by the chart in FIG. 9 is shown as W1. A closer examination of the graph shown in FIG. 9 will show that the current invention is capable of achieving a lower MOI-Z, while keeping the CG-B/Head Width number fairly consistent above 0.34. CG-B/Head Width is indicative of the location of the center of gravity while keeping a moderately sized head width of the golf club head.

In the chart shown in FIG. 9, it can be seen that the present invention occupies a previously unachieved space delineated by a MOI-Z number that is lower than 320 kg-mm$^2$ combined with a CG-B/Head Width number that is greater than about 0.34.

Figure 10:
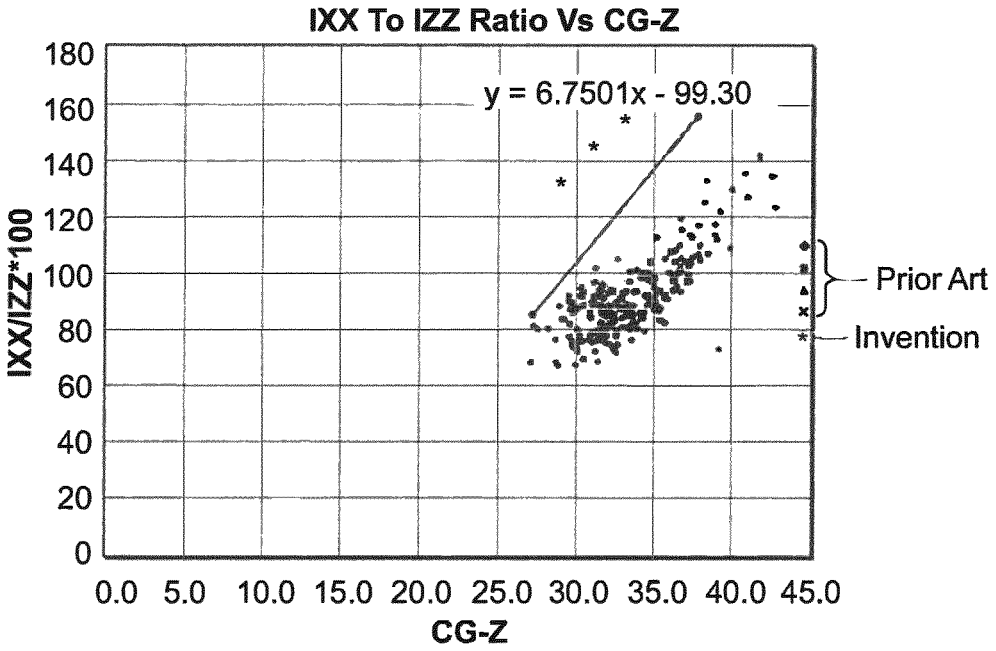
FIG. 10 of the accompanying drawings shows a plot of MOI-X/MOI-Z vs CG-Z numbers for the current invention, compared to prior art golf club heads.

FIG. 10 of the accompanying drawings establishes another graphical relationship of the performance of a golf club in accordance with an embodiment of the present invention. More specifically, FIG. 10 of the accompanying drawings shows a relationship between MOI-X/MOI-Z and CG-Z. (MOI-X is used interchangeably with Ixx, MOI-Y is used interchangeably with Iyy, and finally MOI-Z is used interchangeably with Izz) The definition and measurement for CG-Z of a golf club head can be found in the earlier discussion relating to FIG. 2 of the accompanying drawings, while the background information establishing MOI-X and MOI-Z have already been discussed previously. Although the selection of the plot for the X and Y axis may appear random initially to a person not versed in golf club design, but a closer examination will reveal that the relationship created here is absolutely critical to the proper performance of the present invention. On the Y axis of the plot shown in FIG. 10, a ratio between MOI-X and MOI-Z is created here. This ratio created illustrates the ability of the current inventive golf club head to maximize the value of one variable (MOI-X) while minimizing the value of another variable (MOI-Z); which resonates with the theme of the present invention. The CG-Z used in the X axis of the plot shown in FIG. 10 is indicative of the CG location of the golf club head rearward from the front of the golf club head, and it is desirable to maintain that in the range described above.

A further examination of the plot shown in FIG. 10 will show that the present invention occupies a portion of the graph that was previously unachieved. This portion of the graph is delineated from other prior art data points by an equation Y≥6.7501x−99.30, which when put into context with the variable used in this plot, yields Eq. (7) below:

$$\frac{MOI-X}{MOI-Z} \geq (6.7501 * CG-Z) - 99.30 \quad \text{Eq. (7)}$$

Figure 11:
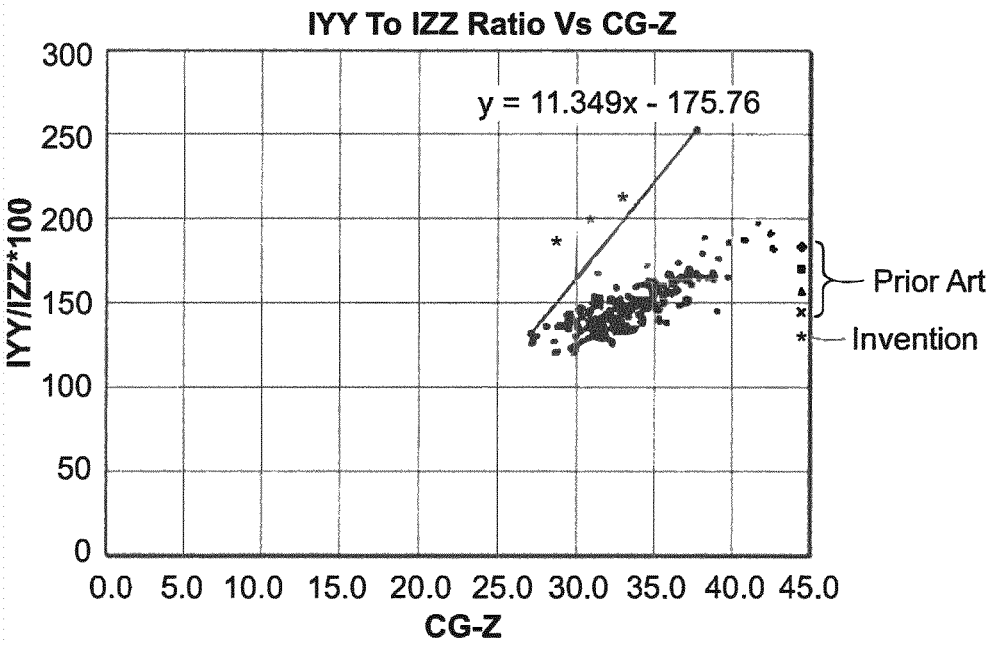
FIG. 11 of the accompanying drawings shows a plot of MOI-Y/MOI-Z vs CG-Z numbers for the current invention, compared to prior art golf club heads.

FIG. 11 of the accompanying drawings establishes another graphical relationship of a golf club in accordance with an embodiment of the present invention by creating a relationship between the MOI-Y/MOI-Z and CG-Z. The definition and measurement for CG-Z of a golf club head can be found in the earlier discussion relating to FIG. 2 of the accompanying drawings, while the background information establishing MOI-Y and MOI-Z have already been discussed previously. Similar to the previous discussion, the relationship between MOI-Y and MOI-Z is indicative of the ability of a golf club to achieve great forgiveness along the MOI-Y axis, while minimizing the MOI-Z of a golf club head to achieve a higher ball speed, as previously discussed. Similar to previous discussion, FIG. 11 of the accompanying drawings shows that the present invention is capable of achieving performance characteristics that was previously unachieved. This portion of the graph is delineated from other prior art data points by an equation Y≥11.349 x−175.76, which when put into context with the variable used in this plot, yields Eq. (8) below:

$$\frac{MOI-Y}{MOI-Z} \geq (11.349 * CG-Z) - 175.76 \quad \text{Eq. (8)}$$

Figure 12:
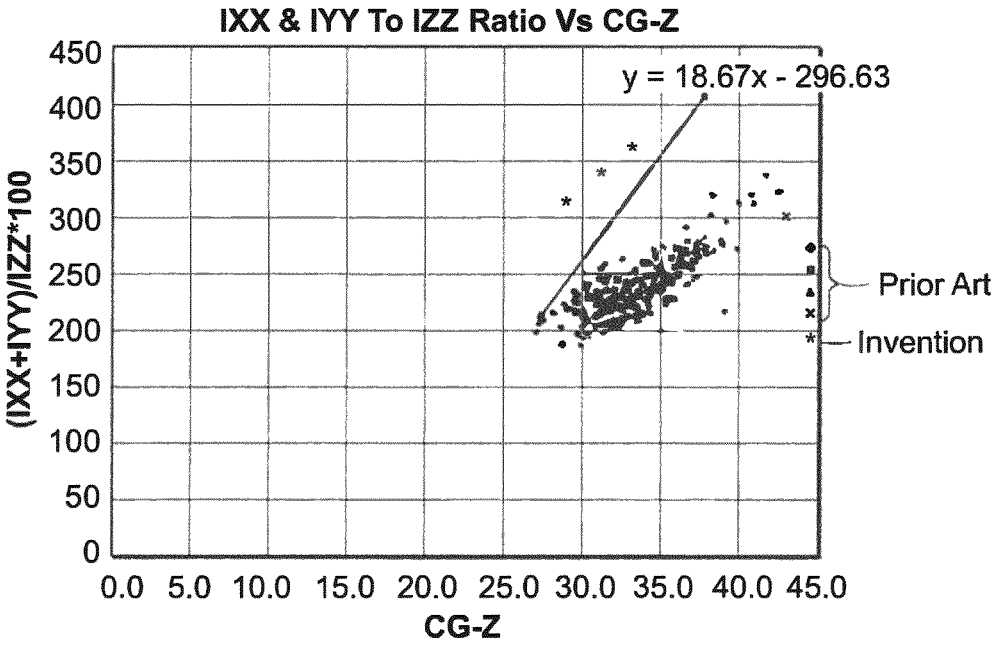
FIG. 12 of the accompanying drawings shows a plot of (MOI-X+MOI-Y)/MOI-Z vs CG-Z numbers for the current invention, compared to prior art golf club heads.

FIG. 12 of the accompanying drawings establishes another graphical relationship of a golf club in accordance with an embodiment of the present invention by creating a relationship between the (MOI-X+MOI-Y)/MOI-Z and CG-Z. The definition and measurement for CG-Z of a golf club head can be found in the earlier discussion relating to FIG. 2 of the accompanying drawings, while the background information establishing MOI-X, MOI-Y, and MOI-Z have already been discussed previously. Similar to the previous discussion, the relationship between MOI-X, MOI-Y, and MOI-Z is indicative of the ability of a golf club to achieve great forgiveness along both the MOI-X and MOI-Y axes, while minimizing the MOI-Z of a golf club head to achieve a higher ball speed, as previously discussed. Similar to previous discussion, FIG. 12 of the accompanying drawings shows that the present invention is capable of achieving performance characteristics that was previously unachieved. This portion of the graph is delineated from other prior art data points by an equation Y≥18.67 x−296.63, which when put into context with the variable used in this plot, yields Eq. (9) below:

$$\frac{(MOI-X + MOI-Y)}{MOI-Z} \geq (18.67 * CG-Z) - 296.63 \quad \text{Eq. (9)}$$

Figure 13:
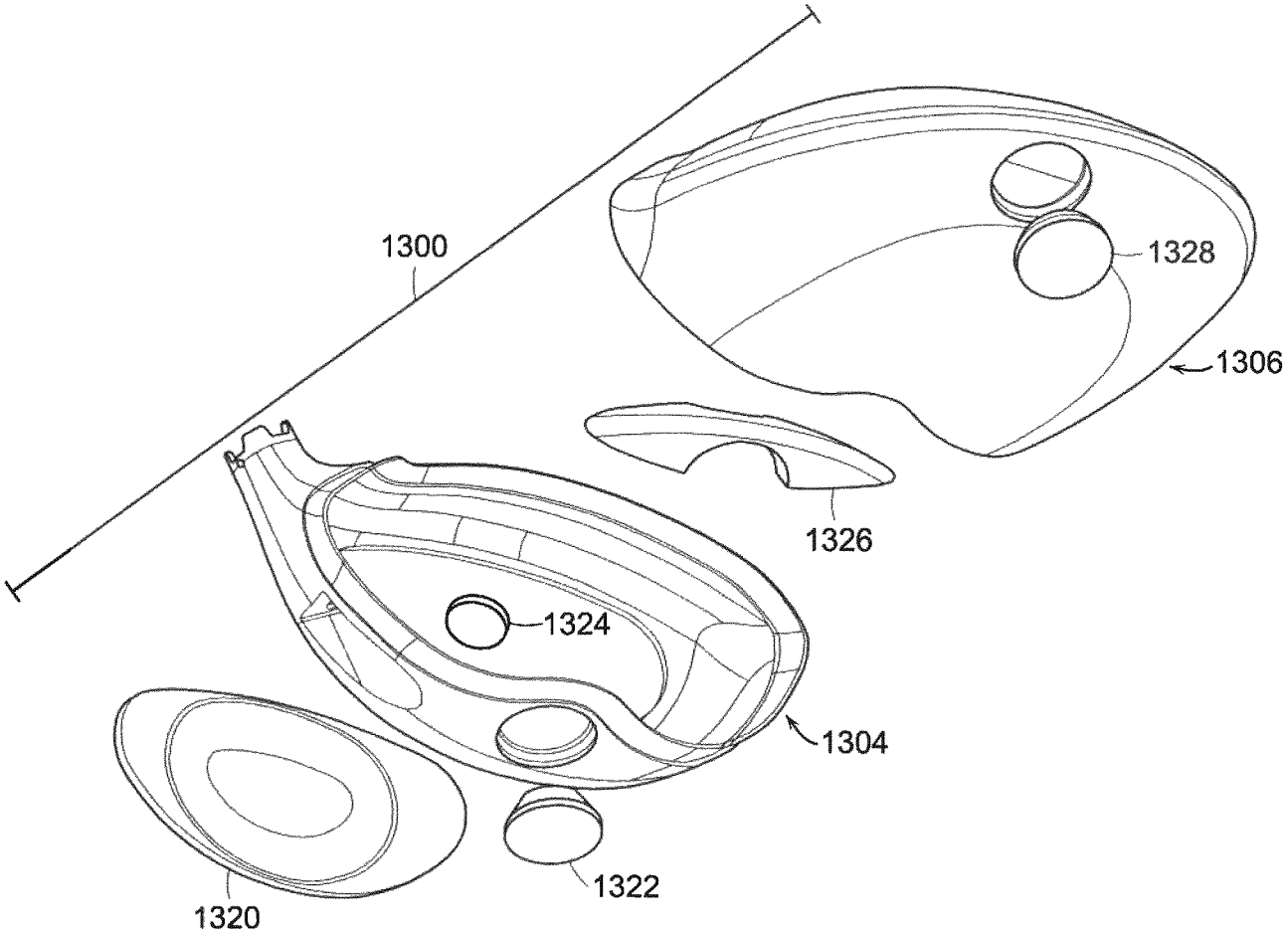
FIG. 13 of the accompanying drawings shows an exploded sole perspective view of a golf club head in accordance with an exemplary embodiment of the present invention.
Figure 14:
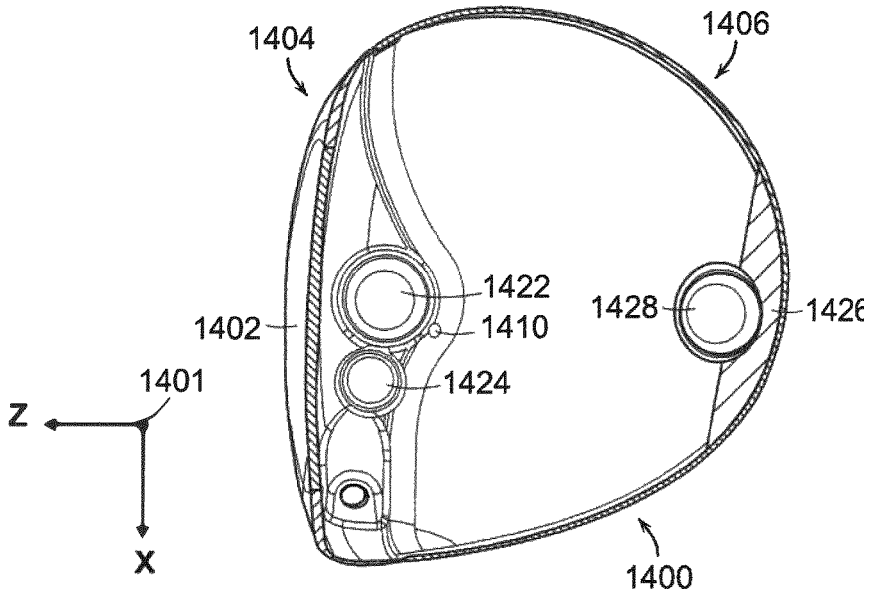
FIG. 14 of the accompanying drawings shows a horizontal cross-sectional view of a golf club head in accordance with an exemplary embodiment of the present invention.
Figure 15:
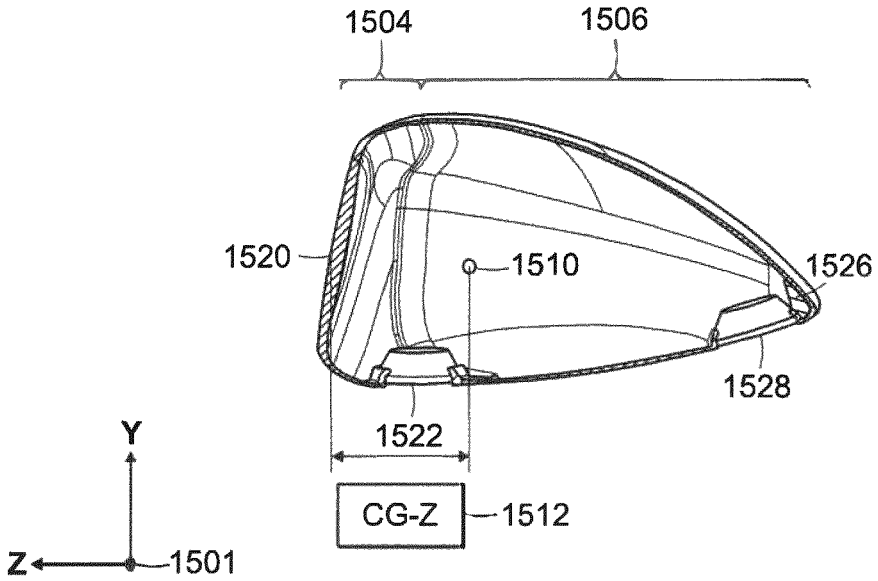
FIG. 15 of the accompanying drawings shows a vertical cross-sectional view of a golf club head in accordance with an exemplary embodiment of the present invention.

FIGS. 13 through 15 show different exploded and cross-sectional view of golf club heads and their internal components that are used to achieve the performance characteristics described above. FIG. 13 shows an exploded perspective view of an exemplary design of a golf club head 1300 in capable of achieving the performance characteristics previously discussed. The golf club head 1300 is made out of the essential components previously discussed in FIG. 1 in terms of a frontal portion 1304 and a rear portion 1306. However, this exploded view of golf club head 1300 allows additional components to be shown in more detail. More specifically, FIG. 13 illustrates that, as often the case in a golf club head construction, the frontal portion 1304 may further be comprised out of a separate component called the striking face insert 1320 to form the striking portion of the golf club head 1300. The rear portion 1306 of the golf club head 1300 is where it gets more interesting. In order to achieve the performance numbers above of a higher MOI-Y, a higher MOI-X, and a lower MOI-Z, a significant amount of mass is re-allocated towards the center of the golf club head away from the perimeter. In order to achieve this, the present invention utilizes four weighting members that are all comprised out of a high density material that have a higher density than the frontal portion 1304 or the rear portion 1306. The four weighting members can be separated into a frontal sole weight 1322, frontal internal weight 1324, rear internal weight 1326, and rear sole weight 1328, and these weighting members may all generally have a material density of greater than 13 g/cc, more preferably greater than about 15 g/cc, and most preferably greater than about 17 g/cc.

It should be noted that in this exemplary embodiment of the present invention, all of the weighting members 1322, 1324, 1326, and 1328 are all made out of the same material having the same heavy density discussed previously. However, in alternative embodiments of the present invention, different densities of tungsten may be used for different weighting members depending on the design criteria and desired CG location all without departing from the scope and content of the present invention.

FIG. 14 of the accompanying drawings shows a cross-sectional view of a golf club head 1400 in accordance with an exemplary embodiment of the present invention. The cross-sectional view of the golf club head taken across a horizontal plane across the face of the golf club head 1400 to allow some of the relationship between the golf club head 1400 and the various weighting member 1422, 1424, 1426, and 1428 to be shown more clearly. In addition to the weighting members, the cross-sectional view of the golf club head 1400 shown in FIG. 14 also allows the face center 1402 and the CG location 1410 to be re-introduced as it relates to the weighting members. It can be seen from this view that at least one weighting member is located near a central portion of the golf club head in a heel to toe direction, and substantially in line with and behind said face center.

FIG. 15 of the accompanying drawings shows a cross-sectional view of a golf club head 1500 in accordance with an exemplary embodiment of the present invention taken along a vertical plane that passes through the center of the face. This cross-sectional view of the golf club head 1500 shown in FIG. 15 provides a little more information on the interworking relationship between the components. More specifically, FIG. 15 shows a striking face insert 1520 being located in the frontal portion 1504 of the golf club head 1500. In addition to the above, FIG. 15 also shows that the frontal sole weight 1522 is located in a receptacle that is created within the frontal portion 1504. Although not shown in this cross-sectional view in FIG. 15, the frontal internal weight is also located in the frontal portion 1504. Attached to the rear of the frontal portion 1504 is the rear portion 1506. The rear portion 1506 forms the aft body portion of the golf club head 1500, and contains the rear internal weight 1526 and the rear sole weight 1528. These weighting members, combined with the unique materials used to form the frontal portion 1504 and the rear portion 1506, allow the golf club head 1500 to achieve the unique performance characteristics outlined previously.

FIGS. 16 through 20 show various perspective and cross-sectional views of a golf club head 1600 in accordance with an alternative embodiment of the present invention that is capable of achieving the performance goals previously mentioned. Similar to the previous embodiment illustrated by FIGS. 1-3 and 13-15, a lot of weighting member is located near the center of the golf club head 1600 in a heel to toe orientation along the x-axis behind the face center 1602 to help minimize the MOI-Z of the golf club head 1600.

Figure 16:
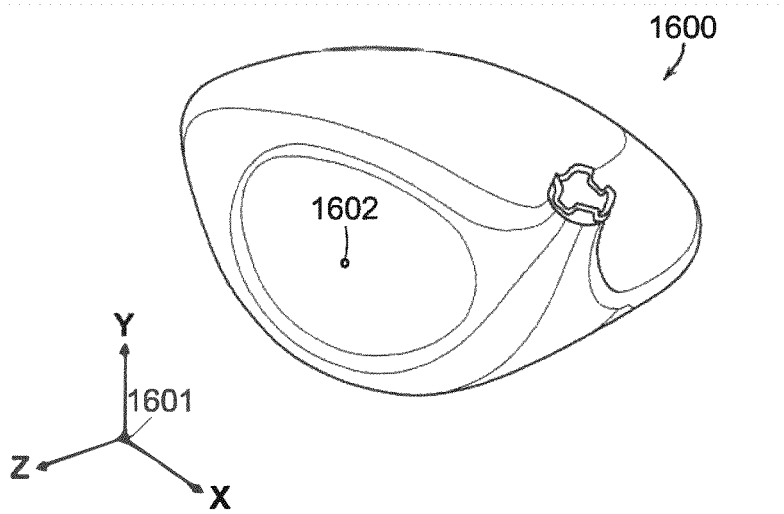
FIG. 16 of the accompany drawings shows a perspective view of a golf club head in accordance with an alternative embodiment of the present invention.

More specifically, FIG. 16 of the accompanying drawings shows a perspective view of a golf club head 1600 in accordance with this alternative embodiment of the present invention. Although not much can be gleamed from this perspective view of the golf club head 1600, it does lay the ground work for the subsequent discussion relating to this particular embodiment of the present invention. Finally, FIG. 16, similar to previous figures that illustrate a golf club head, provides a coordinate system 1601 to guide the subsequent discussions.

Figure 17:
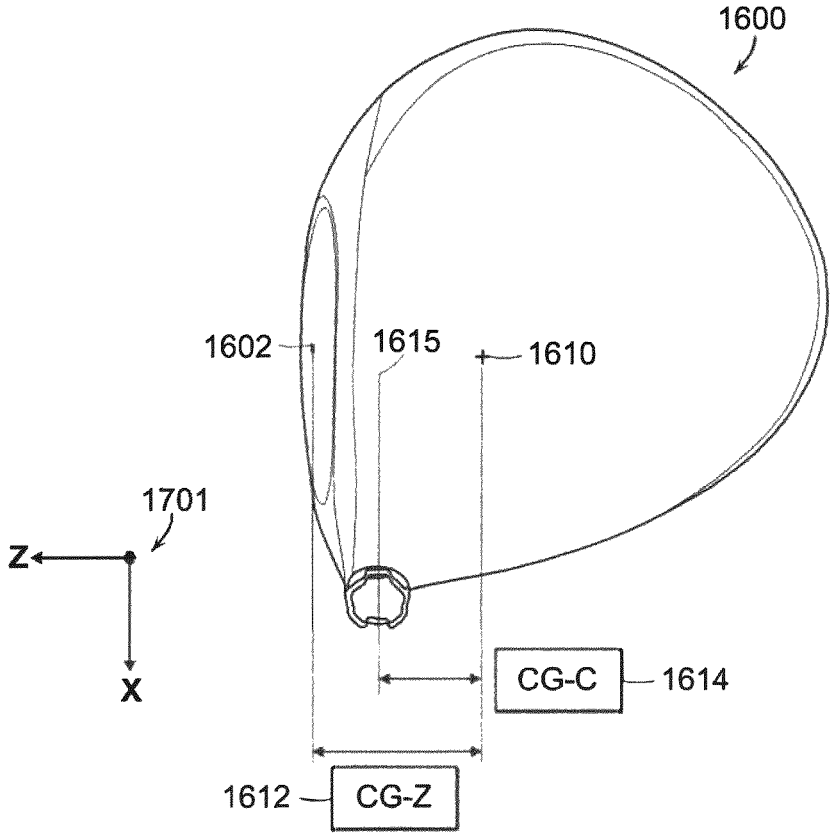
FIG. 17 of the accompanying drawings shows a top view of a golf club head in accordance with an alternative embodiment of the present invention.

FIG. 17 of the accompanying drawings shows a top view of a golf club head 1600 in accordance with this alternative embodiment of the present invention. In this top view, a couple of familiar dimensions are reintroduced here. First and foremost, the top view of the golf club head 1600 shown in FIG. 17 allows the relationship between the face center 1602 and the CG 1610 to be shown in more detail. When measured along the Z-axis, the measurement CG-Z is shown as 1612. The location of the CG, when referenced against the shaft axis 1615 yields another way to measure the CG location along the Z-axis called CG-C 1614. The number ranges for the CG-Z 1612 and CG-C 1614 measurements are not much different from previous discussions, but this embodiment of the present invention provides an alternative way to achieve those targets with a slightly different construction without the need for a multi-material chassis.

Figure 18:
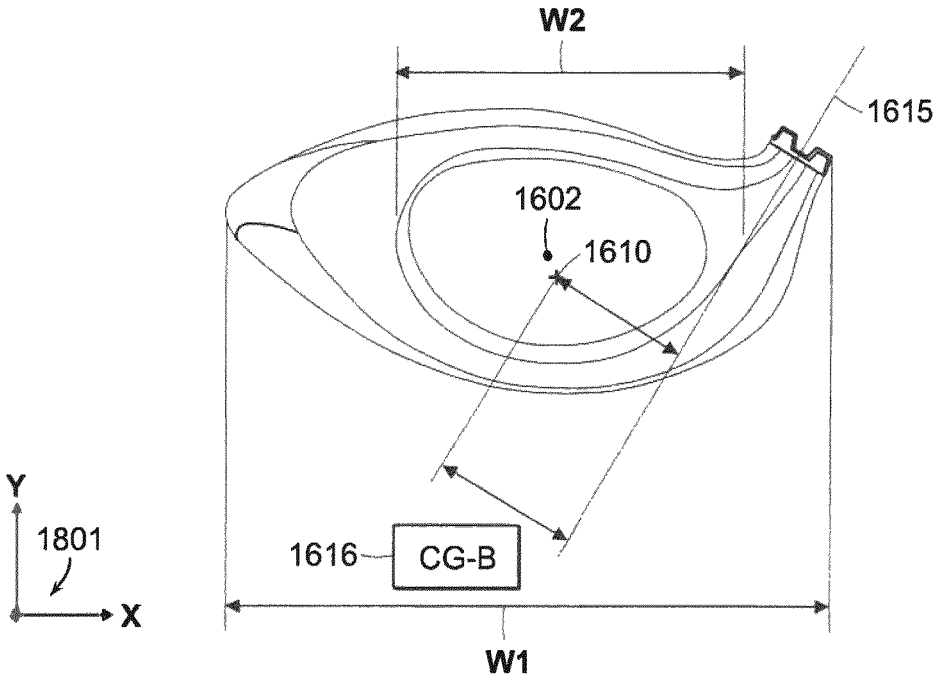
FIG. 18 of the accompanying drawings shows a frontal view of a golf club head in accordance with an alternative embodiment of the present invention.

FIG. 18 of the accompanying drawings shows a frontal view of a golf club head 1600 in accordance with this alternative embodiment of the present invention. In this frontal view, we can see another feature utilized by the present embodiment to help achieve the performance criteria of the current invention. More specifically, FIG. 18 shows that in this embodiment of the present invention, in order to minimize the MOI-Z of the golf club head 1600, weight is removed from the extremities of the golf club head 1600 via a reshaping of the contour at the toe portion of the golf club head 1600. This reshaping of the contour at the toe portion of the golf club head 1600 not only removes weight from the extremities, but also tightens up the face profile of the golf club head 1600 to create a unique performing golf club head 1600.

In addition to illustrating this toe contour profiling, FIG. 18 also shows a CG-B 1616 measurement relating to the shaft axis 1615 similar to the previous discussion. Once again, the CG-B 1616 measurement range is in line as the previous discussion have mentioned, and does not deviate much from the design intent of the present invention.

Figure 19:
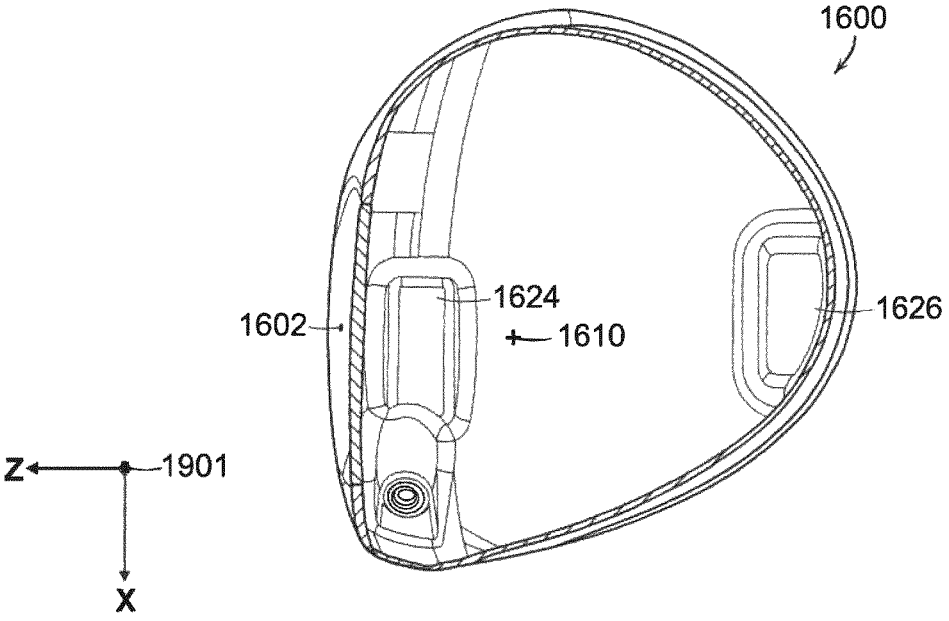
FIG. 19 of the accompanying drawings shows a horizontal cross-sectional view of a golf club head in accordance with an alternative embodiment of the present invention.

FIG. 19 of the accompanying drawings shows a cut open cross-sectional view of a golf club head 1600 in accordance with this alternative embodiment of the present invention taken along a horizontal plane. In this embodiment of the present invention, the overarching theme of placing the weights along the central portion of the golf club head 1600 reemerges again. More specifically, the golf club head 1600 further comprises of a frontal internal weight 1624 and a rear internal weight 1626. These weights, however, different from prior embodiments of the present invention in that they can be made out of the same material as the body portion of the golf club head 1600 such as titanium and be directly cast into the body without departing from the scope and content of the present invention. These weighting members 1624 and 1626 may also be made out of a tungsten type material having a total weight of 20-23 grams to further improve the performance of the golf club head 1600 without departing from the scope and content of the present invention.

Figure 20:
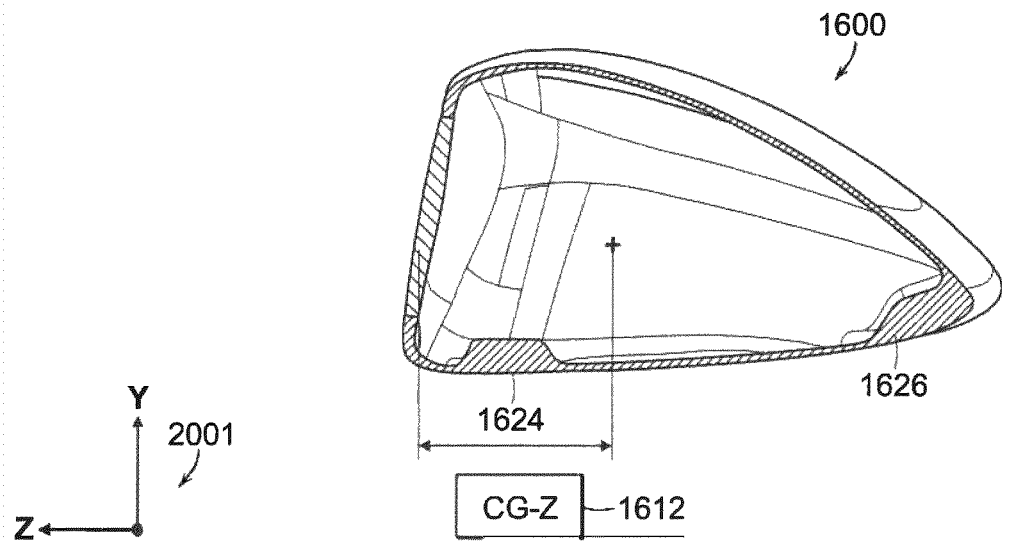
FIG. 20 of the accompanying drawings shows a vertical cross-sectional view of a golf club head in accordance with an alternative embodiment of the present invention.

FIG. 20 of the accompanying drawings provides another cross-sectional cut open view of the golf club head 1600 in accordance with an alternative embodiment of the present invention taken along a vertical plane. Once again, the measurements here are very similar to the discussion previously relating to prior embodiments and the CG-Z 1612 number remain within the same range as the prior discussion. This cross-sectional cut open view of the golf club head 1600 taken along this line allows the profile and geometry of the frontal internal weight 1624 and the rear internal weight 1626 to be shown more clearly and their relationship together with the body portion of the golf club head 1600.

Figure 21:
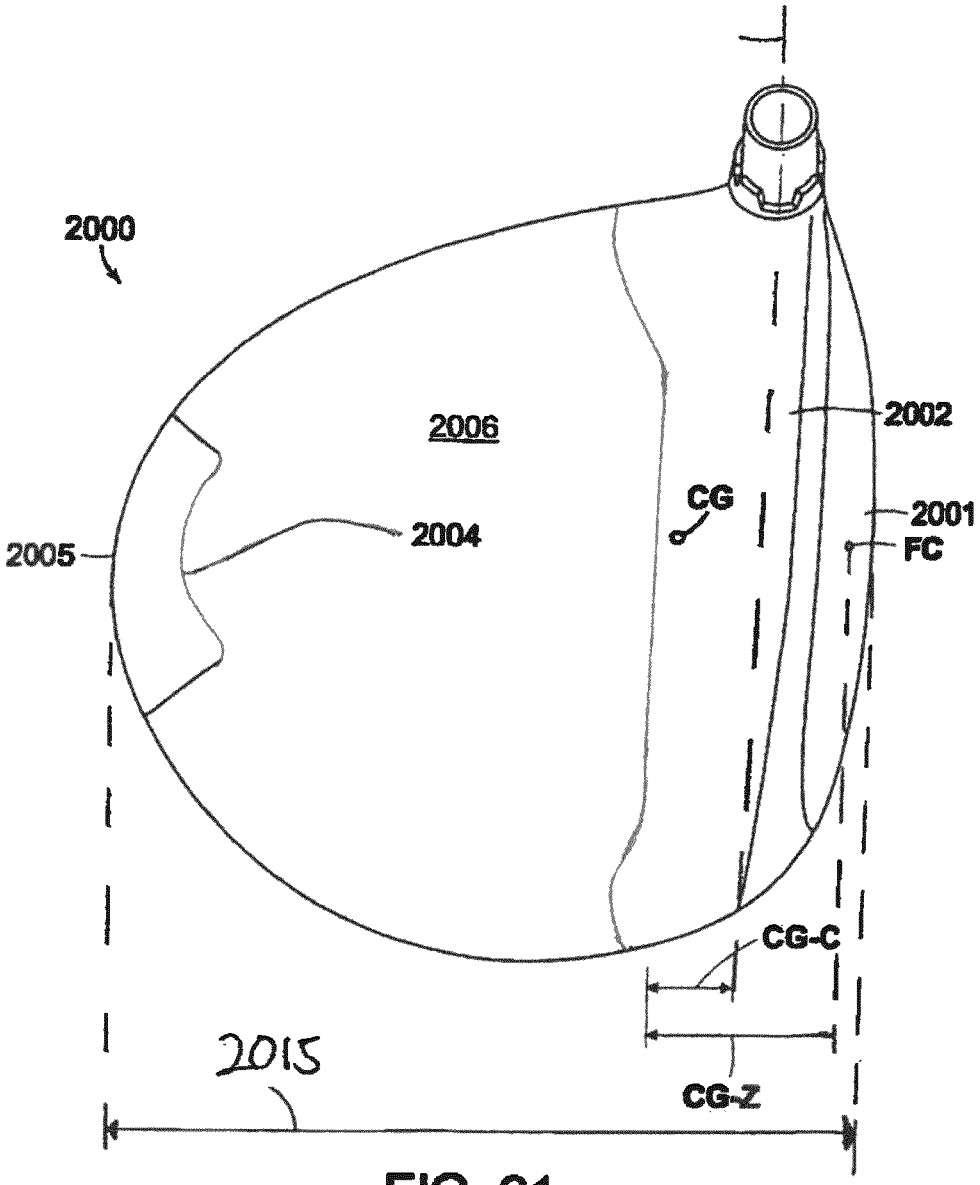
FIG. 21 of the accompanying drawings shows a top view of a golf club head in accordance with an alternative embodiment of the present invention.
Figure 22:
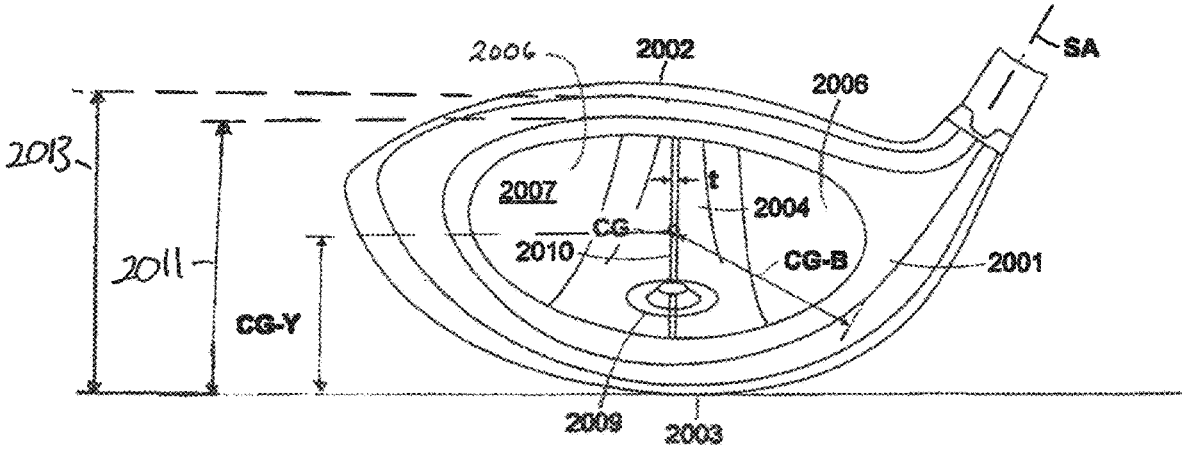
FIG. 22 of the accompanying drawings shows a frontal view of the golf club head in accordance with FIG. 21 with the face insert removed.
Figure 23:
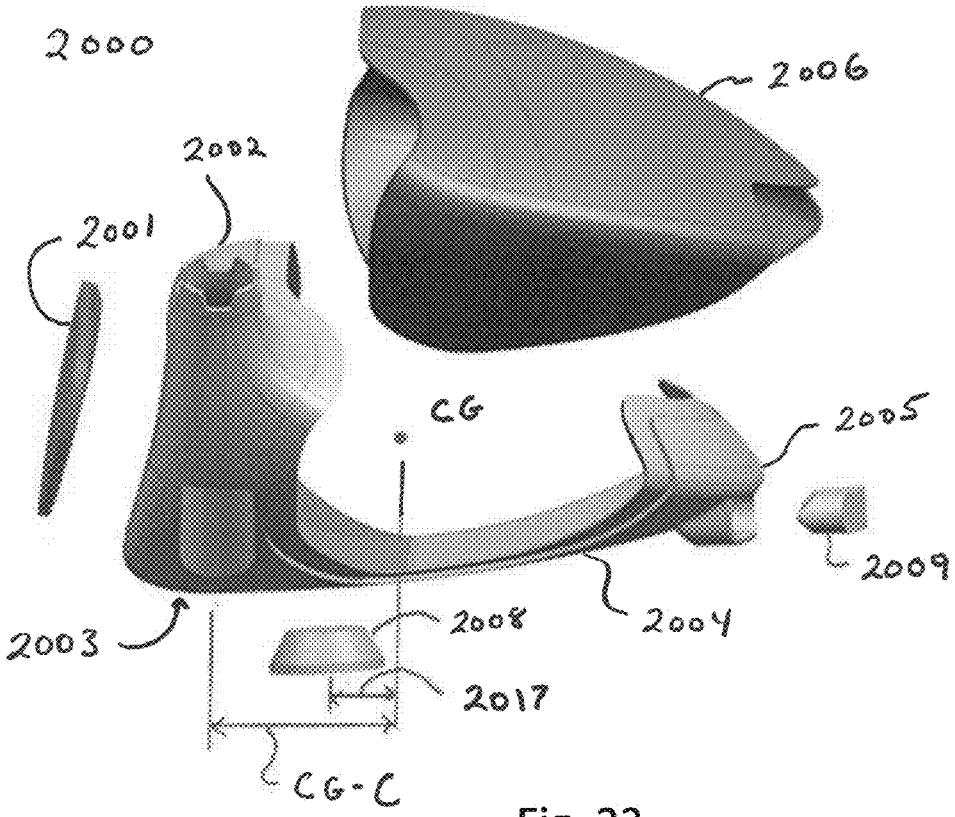
FIG. 23 is an exploded view of the golf club head in FIGS. 21-22 from a heel perspective.

Referring to FIGS. 21-23 the golf club head 2000 has preferred mass and inertial properties as discussed below. Further, the golf club head 2000 comprises frontal portion comprising a striking face 2001 having a face center FC, a crown on the upper portion of the golf club head 2000 and a sole on the bottom portion of the golf club head 2000. The golf club head 2000 further comprises a crown return 2002 and a sole return 2003 as part of the frontal portion and a central body member 2004 that are preferably all formed of metal. The central body member 2004 is located near the central portion of the golf club head 2000 in a heel-to-toe orientation, substantially in line along the z-axis, as set forth above, and extends from the sole return 2003 to a back edge 2005 of the golf club head. The golf club head 2000 is further comprised of a crown body member 2006 made of a non-metallic material and coupled to a toe side and heel side of the central body member 2004 and the crown return 2002 and the sole return 2003 to form an internal cavity 2007. Preferably, as shown in FIG. 23, the central body member 2004 and striking face 2001 are formed of metal such as standard titanium materials such as TI-6-4, Ti-8-1-1, beta-titanium, and others that have a specific gravity of about 4 g/cc to 5 g/cc. Alternatively, the metal portions can preferably be formed of a standard steel materials such as stainless steel 450, that have a specific gravity of about 7 g/cc to 9 g/cc Most preferably, the central body member 2004 is cast from 450 ss and the striking face 2001 is formed from a forged, high-strength steel having a Ultimate Tensile Strength of greater than about 2000 MPa. The crown body member 2006 is preferably formed of a standard composite fiber composite laminate, chopped fiber composite generally referred to as fiber-reinforced plastic (FRP), or a composite material such as those disclosed in U.S. Publication No. 2015-0360094, which is incorporated by reference in its entirety herein. Alternatively, the crown body member 2006 is preferably formed of structural material having a density of less than 3.0 g/cc such as a thermoplastic material such as those disclosed in U.S. application Ser. No. 16/528,210, filed on Jul. 31, 2019, which is incorporated by reference in its entirety herein, polyetherimide (PEI), polyether ether ketone (PEEK), polyphenylene sulfide (PPS), polysulfone (PSU), polyacryletherketone (PAEK), polyetherketoneketone (PEKK) and polyvinyl chloride (PVC). The crown body member 2006 is preferably formed by compression molding, injection molding or 3D printing. The crown body member 2006 is essentially u-shaped as shown in FIG. 23 such that golf club head 2000 has reduced mass along the heel and toe portions and reduced MOI-Y.

In the preferred embodiment, the central body member 2004 is cast from 450 ss and the striking face 2001 is formed of forged AerMet 340 ss. Preferably, the central body member 2004, the crown return 2002, the sole return 2003, and back edge 2005, combined, have a mass of about 80 grams to 110 grams and, more preferably, from about 90 grams to 100 grams. The striking face 2001 preferably has a mass of about 40 grams to 50 grams including the weld to the frontal portion. Overall, the 400 cc golf club head 2000 preferably has a mass of about 190 grams to 200 grams for a 45 inch shaft and 200 grams to 210 grams for a 44 inch shaft.

The golf club head 2000 preferably has a volume of between 250 cc and 400 cc, and more preferably between about 300 cc and 400 cc. Most preferably, the golf club head 2000 has a volume of between 350 cc and 400 cc. Moreover, the golf club head 2000 has a center of gravity CG-Z that is located a distance back from the face center that is greater than or equal to 0.33 times the golf club head depth 2015. Golf club head depth 2015, as referred to in the present invention, is defined as a depth of the golf club head 2000 measured front to back, from the leading edge to the rear most point of the golf club head 2000, along a Z-axis. More preferably, the CG-Z is located a distance back from the face center a distance that is at least 0.35 times the golf club head depth 2015. Still further, the golf club head 2000 has numerous additional features that can help quantify the location of the center of gravity of the golf club head 2000 from various other reference points. The golf club head 2000 has a CG-Y measurement that is a center of gravity a vertical distance up from the ground plane. (shown in FIG. 22) The golf club head also has a CG-B measurement that is the perpendicular distance of the CG, measured from the shaft axis. (Shown in FIG. 22) Finally, the golf club head 2000 also has a CG-C measurement that is the distance of the CG location away from the shaft axis measured along the z-axis as shown in FIG. 21. In the current invention, the CG-Y is generally less than or equal to about 0.4 times the face height, 2011, measured from the ground plane. More preferably, the CG-Y is also generally less than or equal to about 0.35 times the crown height 2013, also measured from the ground plane.

As stated above, it is important that the strategic location of the CG rearward along the z-axis be correct, irrespective of whether it is measured from the face center FC or the shaft axis SA, for the proper functionality of the current inventive golf club head 2000. If the CG location is too far forward, the golf club head 2000 can have a low MOI-X and MOI-Y and low backspin when contacting a golf ball. However, in the alternative, if the CG location is too far rearward or too high, the golf club head 2000 can produce too much spin to yield desirable results. Hence, the CG location rearward along the z-axis and y-axis is important for the performance of the golf club head 2000.

As shown in FIG. 22, the golf club head 2000 can further include a central support member 2010 such as wall member 2010 that is coupled to the central body member 2004. The wall member 2010 preferably has a thickness t that is between 0.2 mm and 5 mm, and more preferably, between about 0.4 mm and 2 mm.

As shown in FIGS. 22 and 23, the golf club head 2000 can further include at least one weight member 2008 and 2009, and more preferably, includes at least two weight members 2008 and 2009. The first weight member 2008 is located on the sole portion of the club head, forward, near the striking face 2001 and the second weight member 2009 is located on the sole portion of the club head, aft, near the back edge 2005. At least one of the weight members may generally have a material density of greater than 13 g/cc, and more preferably greater than about 15 g/cc. In a preferred embodiment, the first weight member 2008 preferably has a mass of between about 10 grams and 30 grams, more preferably between about 15 grams and 25 grams. In a preferred embodiment, the first weight member 2008 is located a distance 2017 of less than or equal to 15 mm from the CG as measured parallel to the z-axis to reduce the MOI-Y. Also, the first weight member 2008, preferably, has greater mass than the second weight member 2009. Most preferably, the first weight member 2008 has a mass that is at least 2 grams greater than the mass of the second weight member 2009.

In another embodiment of the invention, the second weight member 2009 preferably has a mass of between about 20 grams and 50 grams, more preferably between about 25 grams and 35 grams. The first weight member 2008 can have a mass of less than half the mass of the second weight member 2009. More preferably, the weight member 2009 is preferably located a distance of less than 20 mm from the back edge 2005 along the z-axis so that it can have a maximum effect on the spin and launch characteristics of the club head.

The golf club head 2000 also achieves a relative low Moment of Inertia (MOI) about the z-axis (MOI-Z), a low MOI about the shaft axis (MOI-SA), all combined with a high MOI about the x-axis (MOI-X) and low MOI about the y-axis (MOI-Y) and maintaining a consistently and relatively low CG discussed above. Moreover, the preferred embodiment golf club head has an MOI-Y of less than or equal to about 400 kg-mm$^2$ and more preferably less than or equal to about 300 kg-mm$^2$, and most preferably, less than 200 kg-mm$^2$. Furthermore, the golf club head 2000 has a MOI-X, MOI-Y, MOI-Z, CG-Z and CG-Y numbers that satisfies a number of relationships with one another. In one embodiment, the golf club head 2000 can have a MOI-X to MOI-Y of greater than or equal to 0.65 and more preferably between about 0.69 and 0.85. More preferably, the golf club head 2000 also has a MOI-Y to MOI-Z of greater than 1.5, and more preferably greater than about 1.57. Still further, the golf club head 2000 preferably has a MOI-X to MOI-Z ratio of greater than about 1.1, and more preferably greater than about 1.2. The following table demonstrates the difference of the present invention and an all titanium driver, the 915 D5.

| Parameter | Inventive Embodiment | Comparative Example |
|---|---|---|
| Volume (cc) | 400 | 400 |
| CG-X | 0 mm to 2 mm | 1.5 mm |
| CG-Y | 24 mm to 27 mm | 28.3 mm |
| CG-Z | −28 mm to −32 mm | −32.3 mm |
| CG-C | 17 mm to 20 mm | 18 mm |
| MOI-Y (kg*mm$^2$) | 375 kg*mm$^2$ to 400 kg*mm$^2$ | 418 kg*mm$^2$ |
| MOI-X (kg*mm$^2$) | 250 kg*mm$^2$ to 300 kg*mm$^2$ | 256 kg*mm$^2$ |
| MOI-Z (kg*mm$^2$) | 220 kg*mm$^2$ to 240 kg*mm$^2$ | 280 kg*mm$^2$ |
| MOI-SA (kg*mm$^2$) | 625 kg*mm$^2$ to 675 kg*mm$^2$ | |

Figure 24:
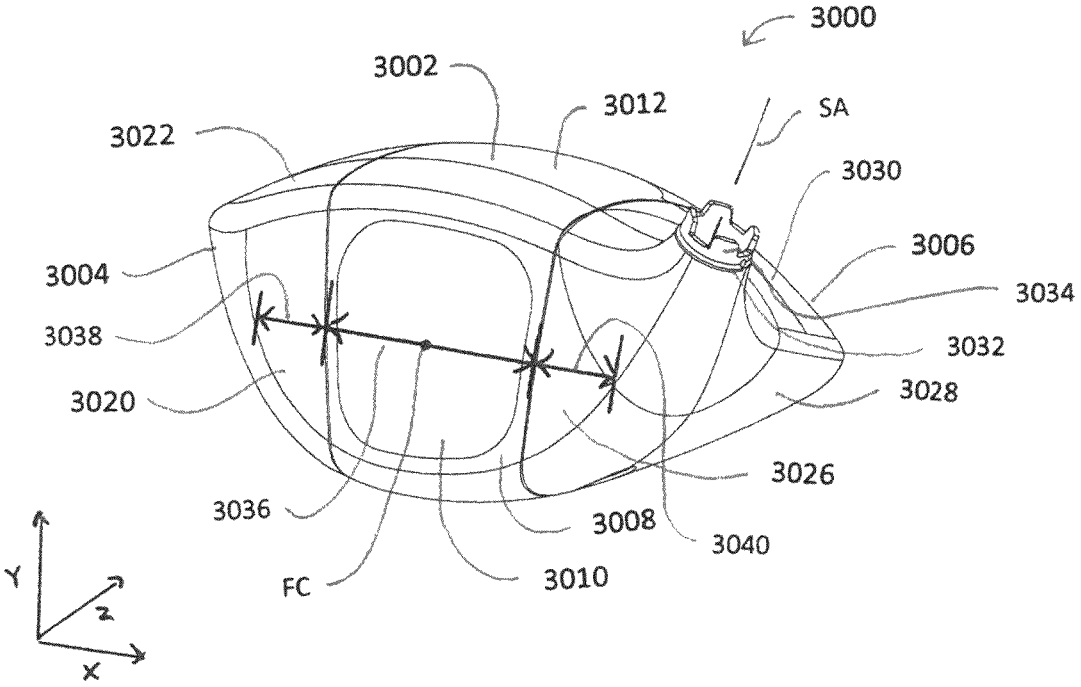
FIG. 24 of the accompanying drawings shows a perspective view of a golf club head in accordance with an alternative embodiment of the present invention.
Figure 25:
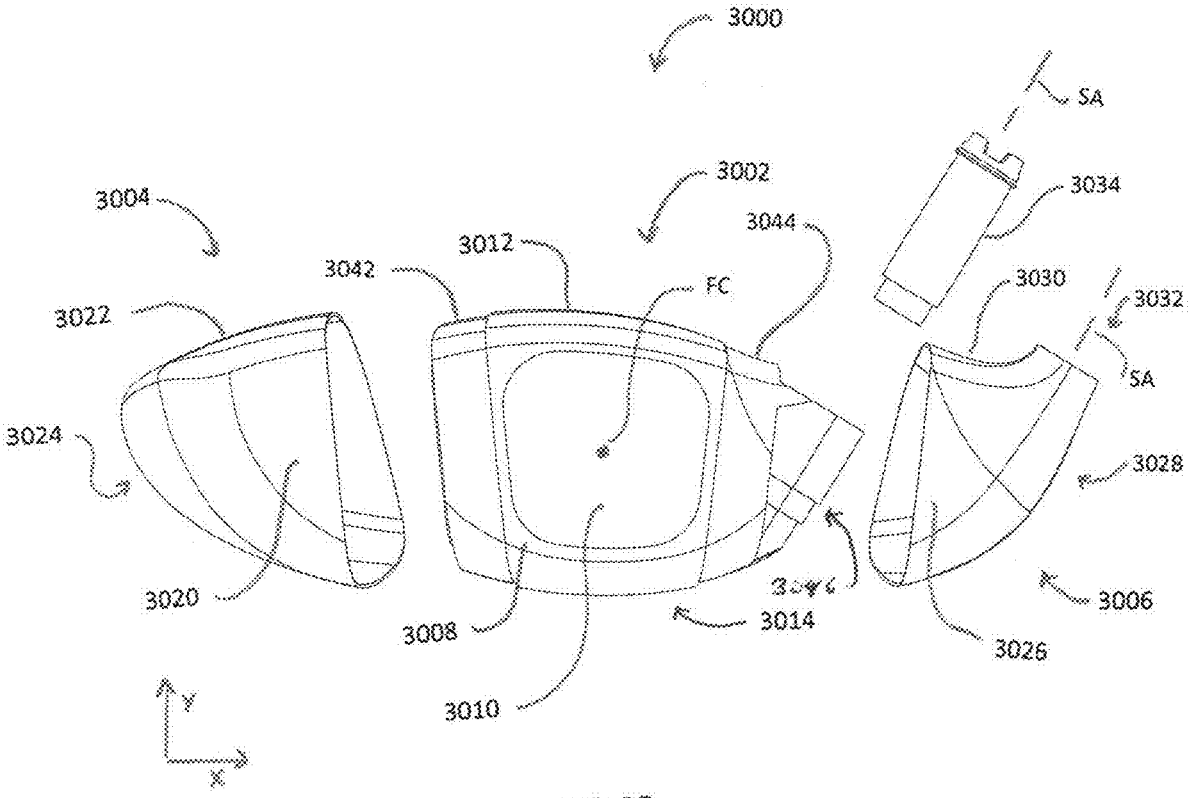
FIG. 25 of the accompanying drawings shows a frontal, exploded view of the golf club head in accordance with FIG. 24.
Figure 26:
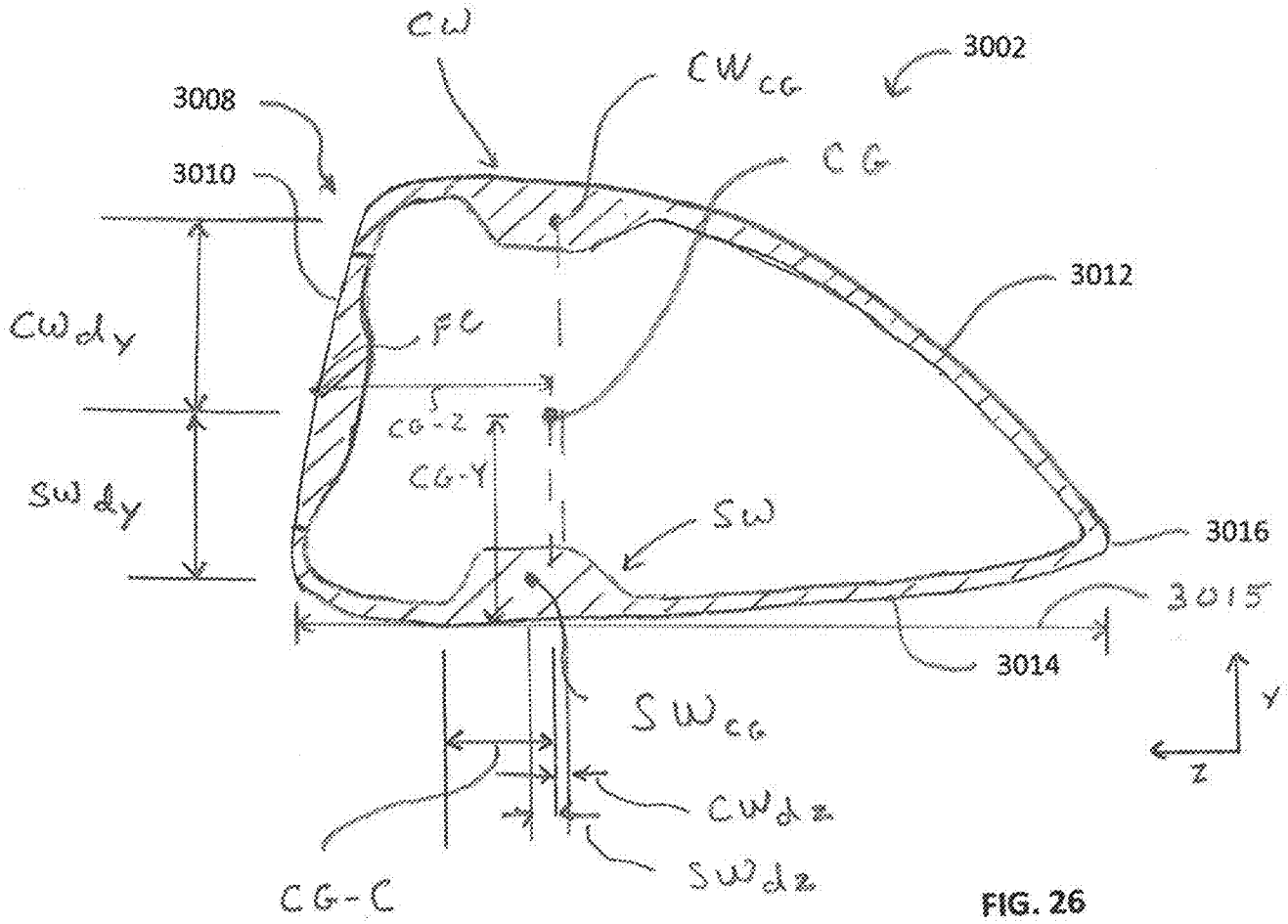
FIG. 26 is a cross-sectional view of a portion of the golf club head in FIGS. 24-25.

Referring to FIGS. 24-26 the golf club head 3000 is a club head having a volume of greater than 420 cc and preferably between 440 cc and 460 cc. and has preferred mass and inertial properties as discussed below. Further, the golf club head 3000 comprises center portion 3002, a toe portion 3004 and a heel portion 3006. The center portion 3002 is comprised of a center face portion 3008 that defines a face center FC. The center portion 3002 is also comprised of a center crown portion 3012 a center sole portion 3014 and a center back edge 3016. Preferably, the center portion 3002 is formed from a cast titanium alloy such as standard titanium materials such as TI-6-4, Ti-8-1-1, beta-titanium, and others and has a stamped or forged face insert 3010 welded to the center face portion 3008. The face insert 3010 preferably has a Ultimate Tensile Strength of greater than about 1250 MPa and is formed of material such as forged ATI 425. The mass of the center portion 3002, with the face insert, is preferably between 80 g and 130 g and more preferably between about 90 g and 105 g.

The toe portion 3004 is comprised of a toe face portion 3020, a toe crown portion 3022 and a toe skirt portion 3024. The heel portion 3006 is comprised of a heel face portion 3026, a heel skirt portion 3028 and a heel crown portion 3030. The heel portion 3006 is further comprised of a hosel receiving aperture 3032 for receiving a hosel 3034, which defines a shaft axis SA. The toe portion 3004 and the heel portion 3006 are preferably comprised of thermoplastic composite materials such as standard composite fiber composite laminate, chopped fiber composite generally referred to as fiber-reinforced plastic (FRP), or a thermoplastic composite material incorporating, polyetherimide (PEI), polyether ether ketone (PEEK), polyphenylene sulfide (PPS), polysulfone (PSU), polyacryletherketone (PAEK), polyetherketoneketone (PEKK) and polyvinyl chloride (PVC). The mass of the toe portion 3004 is preferably between about 15 g and 25 g and the mass of the heel portion 3006 is preferably between about 10 g and 20 g. The mass of the hosel 3034 is preferably between about 6 g and 10 g.

The central portion 3002 can have a constant center width 3036 across the center face portion 3008, the center crown portion 3012 and the central sole portion 3014 or the center face portion 3008 can be one width and the center crown portion 3012 and the center sole portion 3014 can have tapered widths, such that the center portion 3002 has a minimum width at the center back edge 3016, and has a trapizodal shape when viewed from the top. Most preferably, the central face portion 3008 has a center width 3036 that is between about 1.5 inch and 2 inches when measured in the x-direction across the face center FC. The toe face portion 3020 also has a toe width 3038 that is preferably between 0.75 inch and 1 inch when measured in the x-direction across the face center FC. The heel face portion 3026 also has a heel width 3040 that is preferably between 0.75 inch and 1 inch when measured in the x-direction across the face center FC. Most preferably, the toe width 3038 and the heel width 3040 do not differ from each other by more than 0.15 inch and are both less than half of the center width 3036. In another preferred embodiment, the center portion width at the center back edge 3016 is less than 1 inch.

The center portion 3002 can be further comprised of a lower hosel component 3046 that is integrally formed with the center portion 3002 or is formed separately and coupled to the sole portion 3014. The lower hosel component 3046 receives and couples the hosel 3034 to the golf club head 3000.

Referring specifically to FIG. 25, the center portion 3002 is further comprised of a toe recessed ledge 3042 for coupling the toe portion 3004 to the center portion 3002 and a heel recessed ledge 3044 for coupling the heel portion 3006 to the center portion 3002. Preferably, the toe portion 3004 is coupled to the toe recessed ledge 3042 and the heel portion 3006 is coupled to the heel recessed ledge 3044 using an adhesive. As shown, it is preferred that both the toe recessed ledge 3042 and the heel recessed ledge 3044 form a circumferential bonding ledge. In an alternate embodiment, the toe portion 3004 and the heel portion 3006 can fit inside and bond to the inner surface of the center portion 3002.

Referring to FIG. 26, the center portion 3002 is further comprised of a crown weight member CW formed or attached to the center crown portion 3012. The crown weight member CW has mass of about 5 g to about 20 g and more preferably between about 10 g and 15 g. The crown weight member CW also has a center of gravity of the mass $CW_{CG}$ that is near the center of gravity CG for the golf club head 3000 in the z-direction. The center portion 3002 is further comprised of a sole weight member SW formed or attached to the center sole portion 3014. And having a mass of between about 40 g to about 75 g and preferably between about 50 g and 60 g. The sole weight member SW has a center of gravity of the mass $SW_{CG}$ that is also near the center of gravity CG for the golf club head 3000 in the z-direction. Preferably, the distances, in the z-direction, between the center of gravity CG and both the crown weight center of gravity $CW_{CG}$ and sole weight center of gravity $SW_{CG}$, $CW_{dz}$ and $SW_{dz}$ respectively, are less than 0.5 inch, and more preferably less than 0.25 inch, and most preferably less than 0.1 inch. In a preferred embodiment, both the crown weight center of gravity $CW_{CG}$ and sole weight center of gravity $SW_{CG}$ are equivalent or closer, in the z-direction, to the face center FC than the center of gravity CG. The crown weight center of gravity $CW_{CG}$ and sole weight center of gravity $SW_{CG}$ are spaced distances from the center of gravity CG in the y-direction, $CW_{dy}$ and $SW_{dy}$ respectively, that are greater than 0.5 inch, and more preferably greater than 0.6 inch, and most preferably greater than 0.7 inch. By minimizing $CW_{dz}$ and $SW_{dz}$, the moment of inertia about center of gravity about the y-axis, MOI-Y, can be minimized. Conversely, by maximizing $CW_{dy}$ and $SW_{dy}$, the moment of inertia about center of gravity about the x-axis, MOI-X, can be maximized. In this manner, the ratio of MOI-X/MOI-Y can be maximized. Preferably, MOI-Y is less than 400 kg*mm$^2$ and more preferably less than 350 kg*mm$^2$. In a preferably embodiment, the MOI-Y is less than 300 kg*mm$^2$, and most preferably, between about 250 kg*mm$^2$ 300 kg*mm$^2$. Preferably, the golf club head 3000 has a MOI-X of greater than about 200 kg*mm$^2$ and more preferably between about 250 kg*mm$^2$ and 300 kg*mm$^2$. Moreover, the golf club head has a MOI-X/MOI-Y ratio of greater than about 0.7, and more preferably between about 0.75 and 1. The following table demonstrates the difference of the present invention and an all titanium driver, the TS2.

| Parameter | Inventive Embodiment | Comparative Example |
|---|---|---|
| Volume (cc) | 460 | 460 |
| CG-X | 0 mm to 2 mm | 2.0 mm |
| CG-Y | 24 mm to 28 mm | 27.4 mm |
| CG-Z | −28 mm to −34 mm | −36 mm |
| MOI-Y (kg*mm$^2$) | 250 kg*mm$^2$ to 300 kg*mm$^2$ | 505 kg*mm$^2$ |
| MOI-X (kg*mm$^2$) | 200 kg*mm$^2$ to 300 kg*mm$^2$ | 328 kg*mm$^2$ |
| MOI-Z (kg*mm$^2$) | 200 kg*mm$^2$ to 250 kg*mm$^2$ | 314 kg*mm$^2$ |
| MOI-X/MOI-Y | 0.7 to 1 | 0.65 |

Still further, the golf club head 3000 has a center of gravity CG-Z that is located a distance back from the face center that is greater than or equal to 0.33 times the golf club head depth 3015. Golf club head depth 3015, as referred to in the present invention, is defined as a depth of the golf club head 3000 measured front to back, from the leading edge to the rear most point, the center back edge 3016, of the golf club head 3000, along a Z-axis. More preferably, the CG-Z is located a distance back from the face center a distance that is less than 0.35 times the golf club head depth 3015. Still further, the golf club head 3000 has numerous additional features that can help quantify the location of the center of gravity of the golf club head 3000 from various other reference points. The golf club head 3000 has a CG-Y measurement that is a center of gravity a vertical distance up from the ground plane. (shown in FIG. 26) The golf club head 3000 also has a CG-C measurement that is the distance of the CG location away from the shaft axis measured along the z-axis as shown in FIG. 26. In the current invention, the CG-Y is generally less than or equal to about 0.4 times the face height measured from the ground plane. More preferably, the CG-Y is also generally less than or equal to about 0.35 times the crown height, also measured from the ground plane.

As stated above, it is important that the strategic location of the CG rearward along the z-axis be correct, irrespective of whether it is measured from the face center FC or the shaft axis SA, for the proper functionality of the current inventive golf club head 3000. If the CG location is too far forward, the golf club head 3000 can have a low MOI-X and MOI-Y and low backspin when contacting a golf ball. However, in the alternative, if the CG location is too far rearward or too high, the golf club head 3000 can produce too much spin to yield desirable results. Hence, the CG location rearward along the z-axis and y-axis is important for the performance of the golf club head 3000.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:

a center portion extending from a frontal portion to a rear edge and comprising a center face portion having a face center, a center crown portion and a center sole portion;

a toe portion formed from a thermoplastic composite and having a toe mass of 15 g to 25 g, the toe portion extending from the frontal portion and comprising a toe face portion, a toe crown portion and a toe skirt portion;

a heel portion formed from a thermoplastic composite and having a heel mass of 10 g to 20 g, the heel portion extending from the frontal portion and comprising a heel face portion, a heel crown portion, a hosel receiving aperture and a heel skirt portion;

the toe portion and the heel portion being coupled to the center portion such that the center portion, the toe portion and the heel portion define a club head volume of greater than about 420 cc; and at least a crown weight member located on the center crown portion of said golf club head and a sole weight member located on the center sole portion of said golf club head;

wherein an x-axis is defined as a horizontal axis tangent to a geometric center of said center face portion with a positive direction towards a heel of said golf club head, a y-axis is a vertical axis orthogonal to said x-axis with a positive direction towards a crown of said golf club head, and a z-axis being orthogonal to both said x-axis and said y-axis with a positive direction towards the frontal portion, and wherein said golf club head has a center of gravity and a moment of inertia about said x-axis through the center of gravity (MOI-X), a moment of inertia about said y-axis through the center of gravity (MOI-Y), and a moment of inertia about said z-axis through the center of gravity (MOI-Z), and wherein said MOI-Y is less than 400 kg-mm$^2$ and the golf club head has a MOI-X to MOI-Y ratio of greater than about 0.7.

2. The golf club head of claim 1, wherein said MOI-Y is less than 300 kg-mm$^2$.

3. The golf club head of claim 1, wherein the center of gravity is a vertical distance up from a ground plane that is at less than about 0.4 times a face height from the ground plane.

4. The golf club head of claim 1, wherein the center of gravity is a vertical distance up from a ground plane that is at less than about 0.35 times a crown height from the ground plane.

5. The golf club head of claim 1, wherein said MOI-X is less than 300 kg-mm$^2$.

6. The golf club head of claim 5, wherein said MOI-Y is between about 250 kg-mm$^2$ and 300 kg-mm$^2$.

7. The golf club head of claim 1, wherein the crown weight member has a crown weight mass of about 5 g to about 20 g and the sole weight member a sole weight mass of between about 40 g to about 75 g.

8. The golf club head of claim 1, wherein the crown weight member has a crown weight mass of between about 10 g and 15 g and the sole weight member has a sole weight mass of between about 50 g and 60 g.

9. The golf club head of claim 1, wherein the crown weight member has a crown weight mass center of gravity and the sole weight member has a sole weight mass center of gravity that are both spaced from the center of gravity along the z-axis by less than 0.5 inch.

10. The golf club head of claim 9, wherein the crown weight mass center of gravity and the sole weight mass center of gravity are spaced from the center of gravity along the y-axis by greater than 0.5 inch.

11. The golf club head of claim 1, wherein the crown weight member has a crown weight mass center of gravity and the sole weight member has a sole weight mass center of gravity that are both spaced from the center of gravity along the z-axis by less than 0.25 inch.

12. The golf club head of claim 11, wherein the crown weight mass center of gravity and the sole weight mass center of gravity are spaced from the center of gravity along the y-axis by greater than 0.6 inch.

13. The golf club head of claim 12, wherein said center of gravity is spaced a vertical distance up from a ground plane that is less than about 0.4 times a face height from the ground plane.

14. The golf club head of claim 12, wherein said center of gravity is spaced a vertical distance up from a ground plane that is at less than about 0.35 times a crown height from the ground plane.

15. The golf club head of claim 11, wherein the center portion is formed from titanium or titanium alloy and the toe portion and the heel portion are formed from thermoplastic material that is comprised of polyetherimide, polyether ether ketone, polyphenylene sulfide, polysulfone, polyacryletherketone, polyetherketoneketone, or polyvinyl chloride.

16. The golf club head of claim 1, wherein the crown weight member has a crown weight mass center of gravity and the sole weight member has a sole weight mass center of gravity that are both spaced from the center of gravity along the z-axis by less than 0.1 inch.

17. The golf club head of claim 16, wherein the crown weight mass center of gravity and the sole weight mass center of gravity are spaced from the center of gravity along the y-axis by greater than 0.7 inch.

18. The golf club head of claim 1, wherein the center face portion has a center width that is between about 1.5 inch and 2 inches when measured parallel to the x-axis across the face center, the toe face portion has a toe width that is between 0.75 inch and 1 inch when measured parallel to the x-axis across the face center, and the heel face portion has a heel width that is between 0.75 inch and 1 inch when measured parallel to the x-axis across the face center.

19. A golf club head comprising:

a center portion formed from titanium or titanium alloy, extending from a frontal portion to a rear edge and comprising a center face portion, a center crown portion and a center sole portion;

a toe portion formed from a composite and having a toe mass of 15 g to 25 g, the toe portion extending from the frontal portion and comprising a toe face portion, a toe crown portion and a toe skirt portion;

a heel portion formed from a composite and having a heel mass of 10 g to 20 g, the heel portion extending from the frontal portion and comprising a heel face portion, a heel crown portion and a heel skirt portion;

the toe portion and the heel portion being coupled to the center portion to define a club head volume of greater than about 420 cc; and at least a sole weight member located on the center sole portion of said golf club head;

wherein an x-axis is defined as a horizontal axis tangent to a geometric center of said center face portion with a positive direction towards a heel of said golf club head, a y-axis is a vertical axis orthogonal to said x-axis with a positive direction towards a crown of said golf club head, and a z-axis being orthogonal to both said x-axis and said y-axis with a positive direction towards the frontal portion, and wherein said golf club head has a center of gravity and a moment of inertia about said x-axis through the center of gravity (MOI-X), a moment of inertia about said y-axis through the center of gravity (MOI-Y), and a moment of inertia about said z-axis through the center of gravity (MOI-Z), and wherein said MOI-Y is less than 400 kg-mm$^2$ and the golf club head has a MOI-X to MOI-Y ratio of greater than about 0.7.

20. The golf club head of claim 19, wherein the center face portion has a center width that is between about 1.5 inch and 2 inches when measured in a x-direction across a face center;

the toe face portion has a toe width when measured in the x-direction across the face center;

the heel face portion has a heel width when measured in the x-direction across the face center; and wherein the toe width and the heel width do not differ from each other by more than 0.15 inch and the toe width and the heel width are less than half of the center width.

* * * * *